US006580335B1

(12) United States Patent
Iizuka et al.

(10) Patent No.: US 6,580,335 B1
(45) Date of Patent: Jun. 17, 2003

(54) WAVEGUIDE-TRANSMISSION LINE TRANSITION HAVING A SLIT AND A MATCHING ELEMENT

(75) Inventors: Hideo Iizuka, Aichi-ken (JP); Kunio Sakakibara, Aichi-ken (JP); Kunitoshi Nishikawa, Aichi-ken (JP); Kazuo Sato, Aichi-ken (JP); Toshiaki Watanabe, Aichi-ken (JP)

(73) Assignee: Kabushiki Kaisha Toyota Chuo Kenkyusho, Aichi-gun (JP)

( * ) Notice: Subject to any disclaimer, the term of this patent is extended or adjusted under 35 U.S.C. 154(b) by 0 days.

(21) Appl. No.: 09/471,470

(22) Filed: Dec. 23, 1999

(30) Foreign Application Priority Data

Dec. 24, 1998 (JP) ..... 10-366255
Oct. 14, 1999 (JP) ..... 11-291823

(51) Int. Cl.[7] ..... H01P 5/107
(52) U.S. Cl. ..... 333/26; 333/33
(58) Field of Search ..... 333/26, 33

(56) References Cited

U.S. PATENT DOCUMENTS 5,528,074 A * 6/1996 Goto ..... 333/26 X
5,793,263 A 8/1998 Pozar ..... 333/26

FOREIGN PATENT DOCUMENTS

| | | | | |
|---|---|---|---|---|
| FR | 2462787 | * | 3/1981 | ..... 333/26 |
| JP | 02-171006 | | 7/1990 | |
| JP | 02-223201 | | 9/1990 | |
| JP | 4-256201 | | 9/1992 | |
| JP | 08-139504 | | 5/1996 | |
| JP | 2661568 | | 6/1997 | |
| JP | 11-112209 | | 4/1999 | |

OTHER PUBLICATIONS

Wilfried Grabherr, et al. "Microstrip to Waveguide Transistion Compatible with MM–Wave Integrated Circuits," IEEE Transactions on Microwave Theory and Techniques, vol. 42, No. 9, Sep. 1994, pp. 1842–1843.

Nihad Dib, et al. "Analysis of Grounded Coplanar Waveguide Fed Patches and Waveguides," IEEE, 1997, pp. 2530–2533.

W. Simon, et al., IEEE MTT–S International Microwave Symposium Digest, pp. 257–260, "A Novel Coplanar Transmission Line to Rectangular Waveguide Transition", Jun. 7–12, 1998.

Lassi Hyvönen, et al, IEEE MTT–S International Microwave Symposium Digest, pp. 875–878, "A Compact MMIC– Compatible Microstrip to Waveguide Transition", Jun. 17, 1996.

* cited by examiner

*Primary Examiner*—Benny Lee
(74) *Attorney, Agent, or Firm*—Oblon, Spivak, McClelland, Maier & Neustadt, P.C.

(57) ABSTRACT

In a waveguide-transmission line transition, a short-circuiting metal layer is formed on one surface of a dielectric substrate, and the short-circuiting metal layer has a slit in which a strip line is disposed. The short-circuiting metal layer and the strip line are disposed on the same plane with a predetermined gap formed therebetween. A grounding metal layer having a shape substantially congruent with the cross-sectional shape of the opening surface of the waveguide is formed on the other surface of the dielectric substrate. The short-circuiting metal layer, the grounding metal layer, and the waveguide are maintained at the same potential by metal embedded in through-holes provided along the circumferential edge of the dielectric substrate. Further, a matching element is disposed on the surface of the dielectric substrate on which the grounding metal layer is formed. This structure enables formation of substantially the entirety of the transition, except the waveguide, on the same substrate on which a microwave or millimeter-wave circuit or a planar antenna are formed.

30 Claims, 23 Drawing Sheets

WAVEGUIDE-TRANSMISSION LINE TRANSITION HAVING A SLIT AND A MATCHING ELEMENT

BACKGROUND OF THE INVENTION

1. Field of the Invention

The present invention relates to a waveguide-transmission line transition for converting electrical power in a microwave or millimeter-wave band.

2. Description of the Related Art

Japanese Patent Application Laid-Open (kokai) No. 10-126114 (Feeder Transition) discloses a known type of waveguide-transmission.line transition capable of effecting mutual conversion between power transmitted through a waveguide and power transmitted through a strip line.

FIG. 22 is a.perspective view of a waveguide-transmission line transition 300 according to a prior art technique; FIG. 23A and 23C are cross-sectional views of the transition 300; and FIG. 23B is a plan view of the transition 300.

A strip line 3 is provided on one surface of a dielectric substrate 4, and a grounding metal layer 5—which is to be connected to an opening surface of a waveguide 2—is provided on the other surface of the dielectric substrate 4. The dielectric substrate 4 is fixedly sandwiched between a short-circuiting waveguide block 9 and the waveguide 2. Since a high efficiency of the transition is obtained when the strip line 3 is disposed at a position within the waveguide 2 at which a strong electric field is present, the distance between the short-circuiting surface of the short-circuiting waveguide block 9 and the strip line 3 is set to about ¼ of the wavelength x in the waveguide.

When the conventional transition 300 is used to connect the waveguide 2 to a microwave or millimeter-wave circuit, the short-circuiting waveguide block 9 vertically projects from a substrate on which microwave or millimeter-wave circuit is formed, because the strip line. 3 is located on the same plane as that of the substrate of the microwave or millimeter-wave circuit. Especially, when such a transition is used for conversion in a microwave band, the height of the projection ($\lambda/4$) of the short-circuiting waveguide block 9 sometimes exceeds 2 cm, which hinders miniaturization of the microwave circuit.

Meanwhile, when the conventional transition is used for conversion in a millimeter wave band, the matching characteristics of the transition 300 deteriorate when a slight positional shift is produced among the waveguide 2, the short-circuiting waveguide block 9, and the strip line 3. Therefore, in order to obtain a high efficiency of the transition, the waveguide 2, the short-circuiting waveguide block 9, and the strip line 3 must be fixed with positional accuracy as high as about 1/100 mm.

However, the above-described conventional structure makes it difficult to fix the short-circuiting waveguide block 9 and the waveguide 2, among other components, with such high accuracy, and therefore has been a main cause of hindering mass production of waveguide-transmission line transitions.

SUMMARY OF THE INVENTION

The present invention was accomplished in order to solve the above-described problems, and an object of the present invention is to provide a waveguide-transmission line transition which has a high efficiency of the transition and a reduced size, and which can easily be produced on a large scale.

Another object of the present invention is to provide a waveguide-transmission line transition having a structure which prevents variation (deterioration) of properties such as a resonant frequency, which would otherwise occur due to variation in waveguide width among mass-produced waveguides.

According to a first aspect of the present invention, there is provided a waveguide-transmission line transition which includes a strip line projecting inward on an opening surface of a waveguide to be parallel to the opening surface and which effects mutual conversion between power transmitted through the waveguide and power transmitted through the strip line, comprising a plate-shaped short-circuiting member shielding the opening surface of the waveguide and having a slit in which the strip line is disposed; a matching element disposed within the waveguide, the matching element being substantially parallel to and separated by a predetermined distance from the short-circuiting member; and a dielectric member disposed between the short-circuiting member and the matching element, wherein the strip line disposed in the slit and the matching element are disposed in proximity to each other to be electromagnetically coupled.

According to a second aspect of the present invention, as is concretely shown in a first embodiment, the short-circuiting member is a short-circuiting plate having a slit in which the strip line is disposed; and the dielectric member comprises at least a first dielectric substrate which is inserted into the slit and which has the strip line disposed on its outer surface.

According to a third aspect of the present invention, the transition according to the second aspect is further characterized in that the dielectric member comprises a second dielectric substrate which is joined to reverse surfaces of the short-circuiting plate and the first dielectric substrate and on which the matching element is formed.

According to a fourth aspect of the present invention, as is concretely shown in a second embodiment, the dielectric member is formed of a first dielectric substrate shielding the opening surface of the waveguide and a second dielectric substrate which is joined to a reverse surface of the first dielectric substrate and on which the matching element is formed; and the short-circuiting member is formed of a short-circuiting metal layer formed on an outer surface of the first dielectric substrate and having a slit, wherein the strip line is disposed in the slit of the short-circuiting metal layer.

According to a fifth aspect of the present invention, as is concretely shown in a third embodiment, the dielectric member is formed of a dielectric substrate which shields the opening surface of the waveguide and which has the matching element on its reverse surface; and the short-circuiting member is formed of a short-circuiting metal layer formed on an outer surface of the dielectric substrate and having a slit, wherein the strip line is disposed in the slit of the short-circuiting metal layer.

According to a sixth aspect of the present invention, the dielectric substrate or the first dielectric substrate has on its reverse surface, opposite the surface where the strip line is formed, a grounding metal layer which comes into contact with an end face of a side wall at the opening surface of the waveguide.

According to a seventh aspect of the present invention, the short-circuiting metal layer and the grounding metal layer are electrically connected with each other by means of through-holes.

According to an eighth aspect of the present invention, the strip line is disposed in each of a plurality of slits formed in the short-circuiting member.

According to a ninth aspect of the present invention, the grounding metal layer is formed and disposed such that a region surrounded by an inner circumference of the grounding metal layer on the reverse surface of the second dielectric substrate or the dielectric substrate is completely included in a region surrounded by an inner wall of the waveguide.

According to a tenth aspect of the present invention, the center of the matching element is offset from the center of the waveguide by a predetermined distance Δ along the longitudinal direction of the strip line toward the direction of projection of the strip line.

According to an eleventh aspect of the present invention, the predetermined distance Δ falls within a range of about 1 to 4% the narrower wall-to-wall distance P of the waveguide.

According to a twelfth aspect of the present invention, at least two through-holes are disposed on opposite sides of an entrance of the slit; and the distance between the through-holes is less than double the width of the strip line.

According to a thirteenth aspect of the present invention, impedance adjustment is performed through adjustment of a length over which the strip line overlaps with the matching element.

According to a fourteenth aspect of the present invention, resonant frequency adjustment is performed through adjustment of the length of the matching element along a direction parallel to the strip line.

According to a fifteenth aspect of the present invention, the distance between the strip line and the matching element falls within a range of 0.01 to 0.20 λg, where λg is a wavelength within the dielectric member existing between the strip line and the matching element.

According to a sixteenth aspect of the present invention, the distance between the strip line and the short-circuiting metal plate or layer falls within a range of 0.03 to 0.06 λg, where λg is a wavelength within a medium existing between the strip line and the short-circuiting metal plate or layer.

According to a seventeenth aspect of the present invention, the dielectric member on which the strip line is provided is formed integrally with a circuit substrate on which a microwave or millimeter-wave circuit is formed.

According to an eighteenth aspect of the present, invention, the first dielectric substrate and the second dielectric substrate are formed integrally.

According to a nineteenth aspect of the present invention, a second grounding metal layer is formed at a peripheral portion of the second dielectric substrate such that the second.grounding metal layer is in contact with the side wall of the waveguide.

The second grounding metal layer may be formed of the same metal layer as that of the above-described first grounding metal layer. Therefore, a metal layer which concurrently meets the requirements of the first and second metal layers may sometimes be referred to as a "grounding metal layer" without distinguishing them.

The above-described waveguide-transmission line transition can solve the problems involved in conventional waveguide-transmission line transitions.

In the waveguide-transmission line transition according to the present invention, the strip line disposed in the slit of the short-circuiting metal plate or layer is disposed in close proximity to the matching element to establish electromagnetic coupling, i.e., capacitive coupling, therewith, so that power conversion is effected by the electromagnetic coupling between the strip line and the matching element. Accordingly, a short-circuiting waveguide block which has been indispensable in the conventional waveguide-transmission line transition—can be omitted. Therefore, there can be eliminated the above-described projection which projects about λ/4 from the substrate surface of a microwave or millimeter-wave circuit, to thereby enable flattening of (rendering compact) the waveguide-transmission line transition.

Further, since the short-circuiting waveguide block is eliminated, an operation for precise relative positioning between the short-circuiting waveguide block and the waveguide, accompanied by λ/4 restriction, becomes unnecessary, so that production of the waveguide-transmission line transition is facilitated.

Moreover, in the waveguide-transmission line transition according to the present invention, impedance matching is effected through adjustment of the length of insertion of the strip line into the waveguide. Further, a frequency band in which transmission and conversion are performed can be determined through adjustment of the size of the matching element and the distance between the strip line and the matching element.

When the width of the matching element as.measured along the longitudinal direction of the cross section of the waveguide is large, the frequency band becomes broader. In addition, the width of the matching element as measured along a direction perpendicular to the longitudinal direction determines the cut-off frequency. Further, the width of the frequency band changes with the distance between the matching element and the strip line (the thickness of a dielectric substrate interposed therebetween).

Accordingly, through proper adjustment of these parameters, there can be obtained a waveguide-transmission line transition whose loss at a desired frequency is reduced.

Since the grounding metal layer is provided, the dielectric substrate on which the strip line is provided can be easily and reliably fixed to the waveguide. Therefore, a waveguide-transmission line transition of reduced power loss can be obtained.

When a conductive material such as metal is embedded in through-holes formed in the dielectric substrate, it becomes possible to reliably maintain the short-circuiting metal layer and the waveguide at the same potential. Therefore, a waveguide-transmission line transition of reduced power loss can be obtained.

Since the inner dimension of the grounding metal layer is made smaller than the inner dimension of the waveguide, the distance between the matching element and the conductor (grounding metal layer) formed on the same surface can be maintained constant even when the width of the waveguide varies during mass production. Accordingly, electromagnetic fields produced between the matching element and the grounding metal layer hardly change, so that variation in resonant frequency can be suppressed.

That is, the accuracy of the waveguide width of a waveguide produced through metal working is a few tens of, microns to a few hundreds of microns. By contrast, the accuracy of the strip line formed on the dielectric substrate can be decreased to ten microns or less. Therefore, according to the present invention, deterioration in characteristics due to production errors can be reduced, as compared with the structure in which the resonant frequency changes depending on the width of the waveguide.

In the present invention, the positional relationship between the waveguide and the dielectric substrate is not determined such that the centers of the waveguide and the dielectric substrate coincide with each other, but is determined such that the dielectric substrate is located in the vicinity of the center of a region in which the conversion loss is small. Therefore, the conversion loss does not increase very much even when a positional shift is produced therebetween.

In the present invention, since the distance between two through-holes sandwiching a planar transmission line is sufficiently small, the ratio of power which leaks from the gap between the two through-holes (from an area in the vicinity of the entrance of the slit of the short-circuiting metal layer), i.e., the ratio of the power loss to the total power transmitted from the transmission line to the waveguide, can be reduced.

In the present invention, the distance between the short-circuiting metal layer and the matching element can be increased through provision of the first and second dielectric substrates therebetween. Thus, a frequency band in which power transmission and conversion are performed can be broadened.

In the present invention, the second grounding metal layer—which is provided on the surface of the second dielectric substrate on which the matching element is formed—enables to broaden a frequency band in which power transmission and conversion are performed and to prevent variation (deterioration) of properties of a resonant frequency even when variation occurs in waveguide width among waveguides.

BRIEF DESCRIPTION OF THE DRAWINGS

FIGS. 2A, 2C, and 2D are cross-sectional views of the transition 100 of the first embodiment, and FIG. 2B is a plan view of the transition of the first embodiment, in which FIG. 2A is a sectional view along line A–A' in FIG. 2B, FIG. 2C is a sectional view along line C–C' in FIG. 2A and FIG. 2D is a sectional view along line D–D' in FIG. 2A.

DESCRIPTION OF THE PREFERRED EMBODIMENTS

Embodiments of the present invention will now be described with reference to the drawings, where the same reference labels in different drawings refer to the same features and which may not be described in detail for all drawings.

Figure 1:
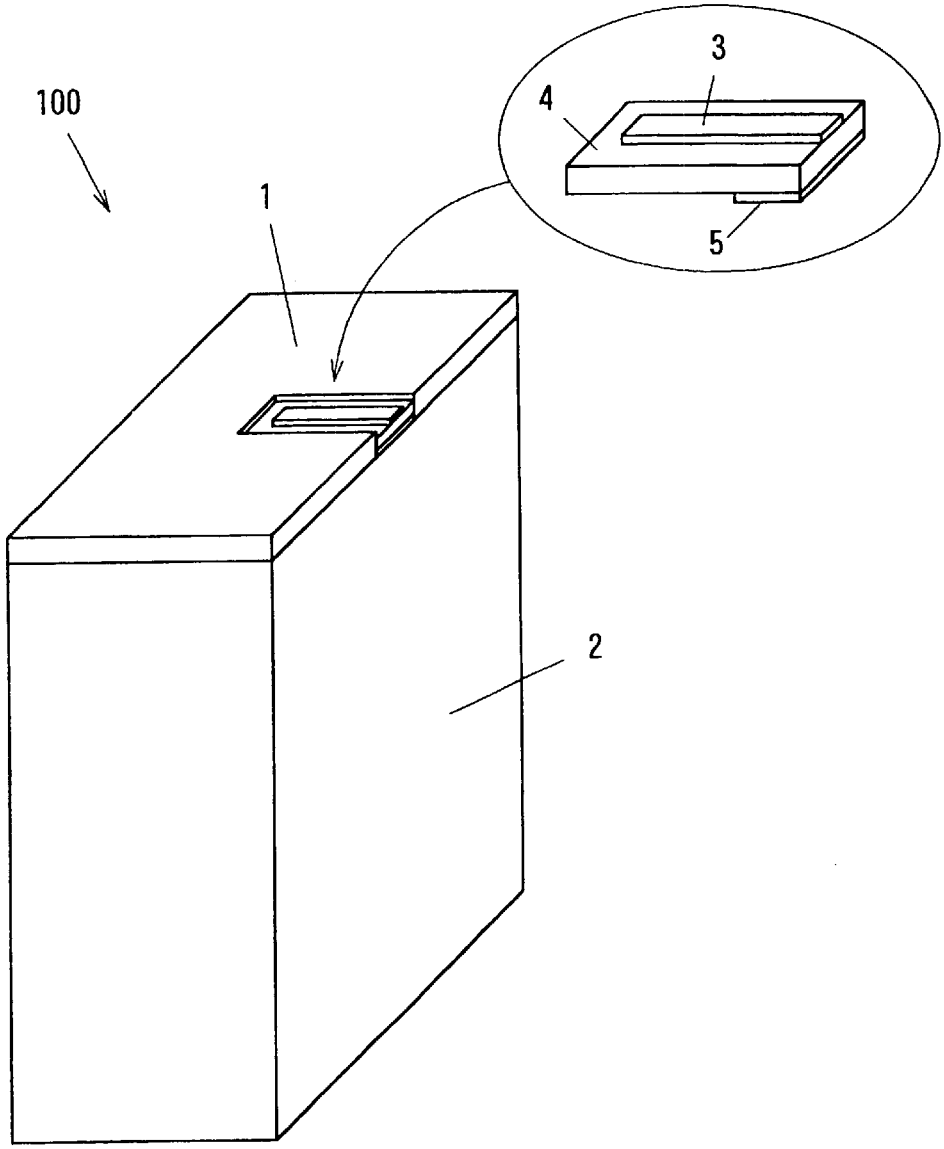
FIG. 1 is a perspective view of a waveguide-transmission line transition 100 of a first embodiment.
Figures 2A, 2B, 2C, 2D:
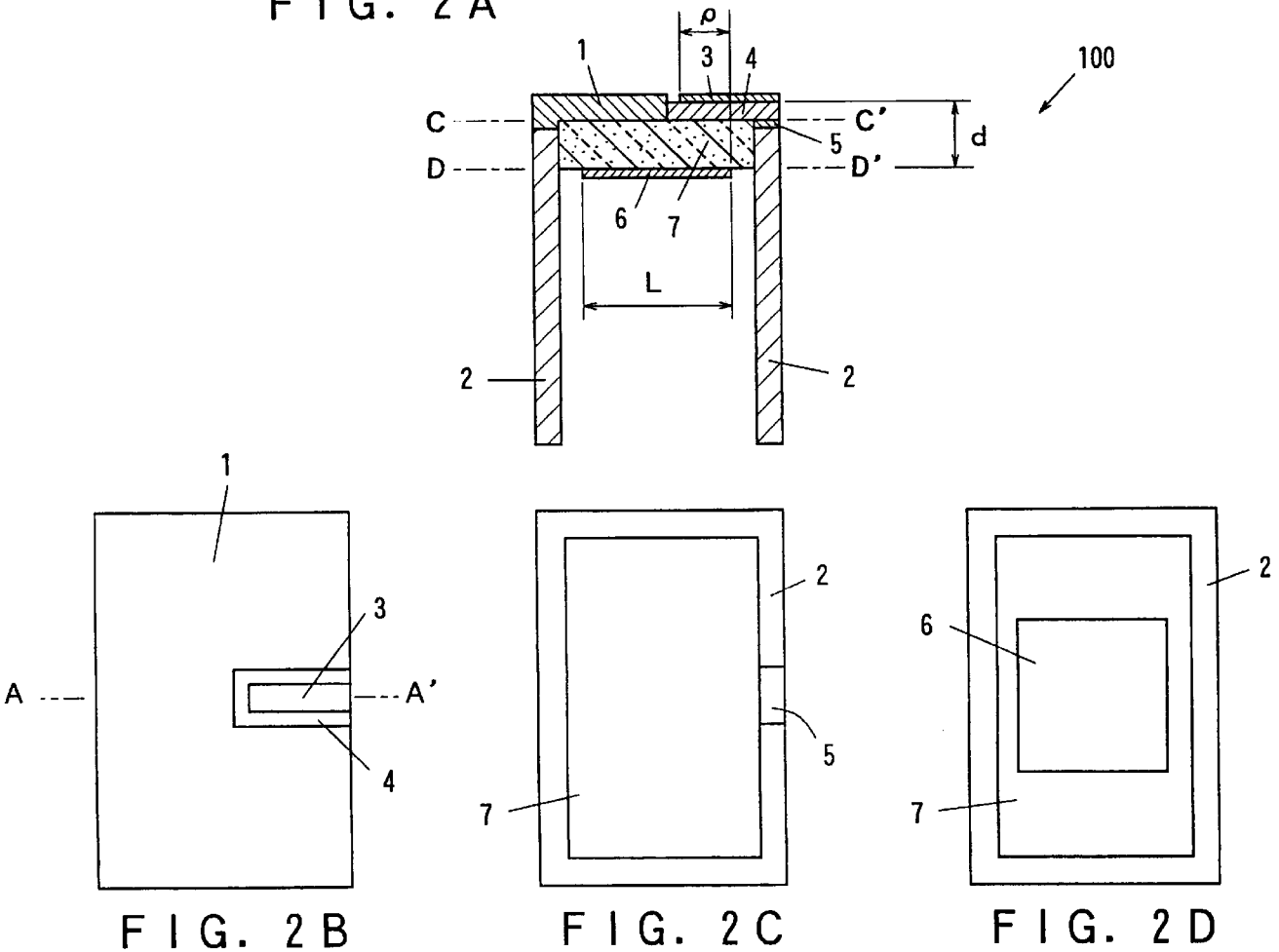

First Embodiment:

FIG. 1 is a perspective view of a waveguide-transmission line transition 100 of a first embodiment; FIGS. 2A, 2C, and 2D are cross-sectional views of the transition 100; and FIG. 2B is a plan view of the transition 100.

A strip line 3 is provided on one surface of a dielectric substrate (first dielectric substrate) 4, and a grounding metal layer 5 is provided on the other surface of the dielectric substrate 4. The ground metal layer 5 has a rectangular shape whose width is substantially the same as the thickness of the side wall of a waveguide 2. These conductors (the strip line 3 and the grounding metal layer 5) are formed by photo etching or any other suitable method.

A slit whose shape is substantially congruent with the planar shape (rectangular shape) of the dielectric substrate 4 is formed in a short-circuiting plate 1. The dielectric substrate 4 is fitted into the slit of the short-circuiting plate 1, and the grounding metal layer 5 is brought into close contact with and fixed to the opening surface of the waveguide 2 through welding, soldering, or any other suitable method. Thus, the transition 100 is fixed to the opening surface of the waveguide 2.

A dielectric substrate (second dielectric substrate) 7 is disposed within the opening surface of the waveguide 2. The dielectric substrate 7 (see FIG. 2A) is brought into close contact with and fixed to the dielectric substrate 4 and the short-circuiting plate 1.

A metal layer of a substantially square shape is formed, through photo etching, at the center of a surface of the dielectric substrate 7 opposite the strip line 3. The metal layer will be referred to as a "matching element 6" (see FIG. 2A), because of its function. Since the matching element 6 is disposed in proximity with the strip line 3, electromagnetic coupling is established between the matching element 6 and the strip line 3.

The above-described structure eliminates the projection of the conventional waveguide-transmission line transition 300, which projects about $\lambda/4$ from the substrate surface of a microwave or millimeter-wave circuit, to thereby enable flattening of (rendering compact) the waveguide-transmission line transition. Further, the operation for precise relative positioning between the short-circuiting waveguide block 9 and the waveguide 2, accompanied by $\lambda/4$ restriction, becomes unnecessary, so that production of the waveguide-transmission line transition is facilitated.

Moreover, in the structure of the waveguide-transmission line transition 100 according to the present embodiment, impedance matching is effected through adjustment of the length of insertion of the strip line into the waveguide. Further, a frequency band in which transmission and conversion are performed can be determined through adjustment of the area of the matching element. Therefore, it becomes possible to realize a waveguide-transmission line transition which produces a reduced loss at a desired operation frequency.

Figure 9:
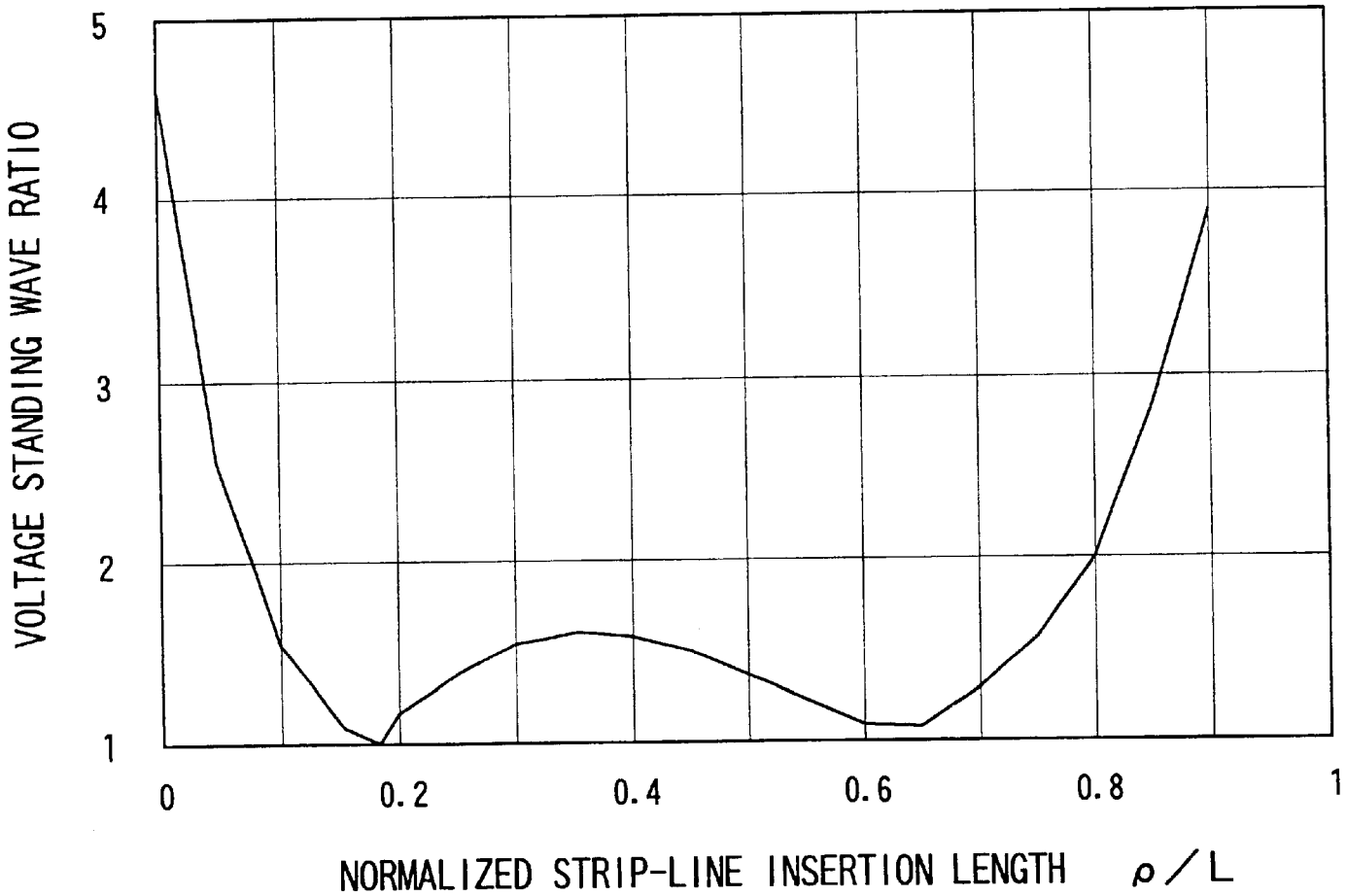
FIG. 9 is a characteristic chart obtained through determination of the relationship between normalized strip-line insertion length and voltage standing wave ratio of the waveguide-transmission line transition 100 of the first embodiment.

FIG. 9 shows the relationship between the input-side voltage standing wave ratio and the length of insertion $\rho$ of the strip line 3 into the waveguide 2. As shown in FIG. 2A, the strip-line insertion length $\rho$ is a length over which the strip line 3 overlaps with the matching element 6 in a direction parallel to a shorter side of the waveguide 2. The horizontal axis represents a normalized value $\rho/L$ (hereinafter referred to as a "normalized strip-line insertion length"), which is obtained through division of the strip-line insertion length $\rho$ by the matching element length L as measured along a direction parallel to the shorter side of the waveguide 2.

When the strip line length $\rho$ is set to satisfy the relationship $0.11\ L \leqq \rho \leqq 0.28\ L$ or $0.45\ L \leqq \rho \leqq 0.73\ L$, the input-side voltage standing wave ratio can be reduced to, 1.5 or less. As described above, the input-side voltage standing wave ratio can be adjusted through adjustment of the strip line length $\rho$. That is, impedance matching can be realized on the input and output sides of the transition.

Figure 10:
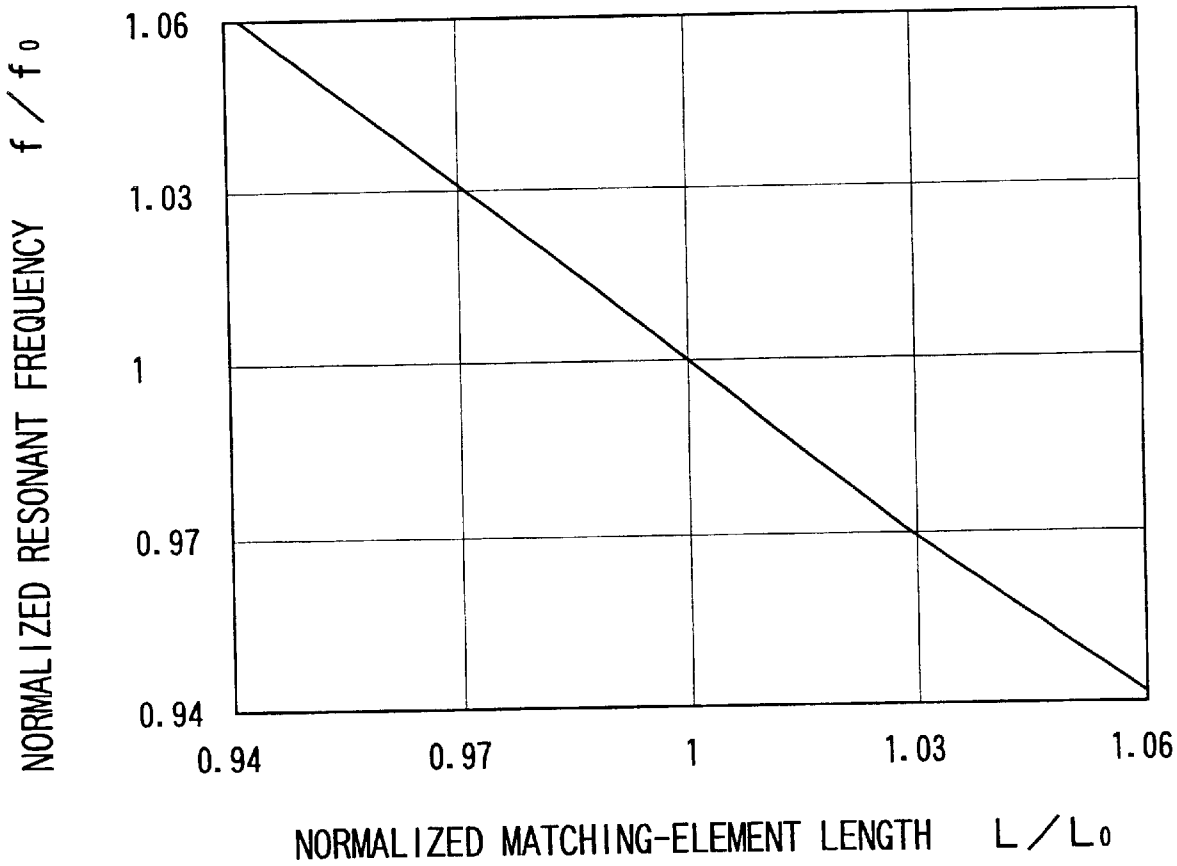
FIG. 10 is a characteristic chart obtained through determination of the relationship between normalized matching-element length and normalized resonant frequency of the waveguide-transmission line transition 100 of the first embodiment.

FIG. 10 shows the relationship between matching-element length L and resonant frequency f. The horizontal axis represents a normalized value $L/L_0$ (hereinafter referred to as a "normalized matching-element length"), which is obtained through division of the matching-element length L by a predetermined matching-element length $L_0$. The vertical axis represents a normalized value $f/f_0$ (hereinafter referred to as a "normalized resonant frequency"), which is obtained through division of the resonant frequency f by a predetermined resonant frequency $f_0$. It is to be noted that when the matching-element length is $L_0$, the resonant frequency becomes $f_0$.

Since the resonant frequency f decreases as the, matching-element length L increases, it is understood that the resonant frequency f can be controlled through adjustment of the matching-element length L.

In the structure of the waveguide-transmission line transition 100 of the present embodiment, power loss can be reduced when the distance d between the strip line 3 and the matching element 6 as measured along the axis of the waveguide 2 (the total thickness of the dielectric substrates 4 and 7 shown in FIG. 2A) is set to satisfy the relationship $0.01\ \lambda g \leqq d \leqq 0.20\ \lambda g$, where $\lambda g$ represents a transmission wavelength within the dielectric substrate.

Also, such a low power-loss characteristic can be realized when the dielectric constants of the dielectric substrates 4 and 7 are set to fall within a range of 1 to 10.

Further, such a low power-loss characteristic can be realized when the distance between the short-circuiting plate I and the strip line 3 is set to fall within a range of $0.03\ \lambda g$ to $0.06\ \lambda g$, in which electromagnetic fields around the strip line 3 do not become disrupted and leakage of power from the gap between the short-circuiting plate 1 and the strip line 3 is suppressed.

Figure 11:
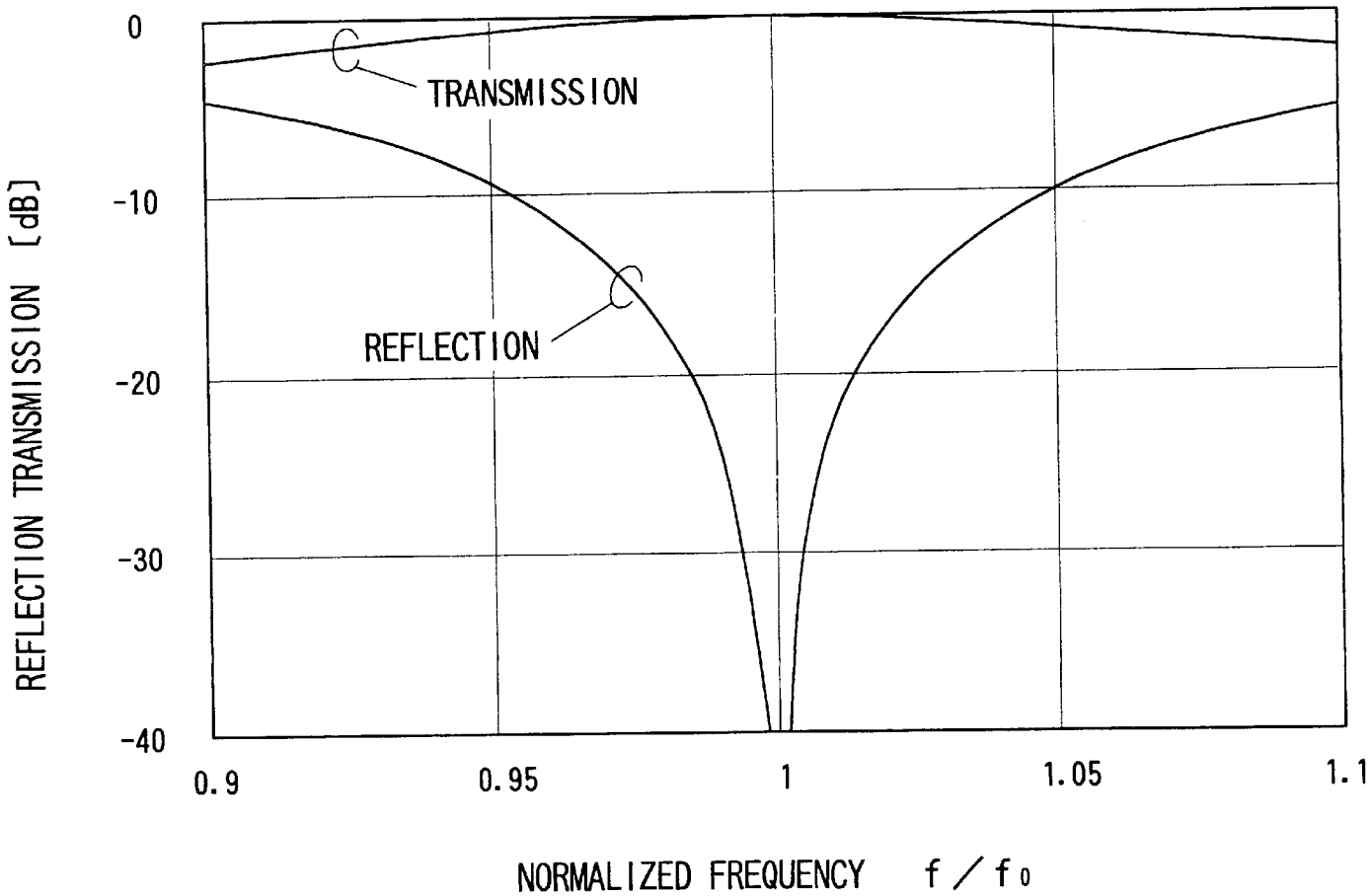
FIG. 11 is a characteristic chart obtained through determination of the relationship among normalized frequency, reflection, and transmission of the waveguide-transmission line transition 100 of the first embodiment.

FIG. 11 shows frequency characteristics of reflection and transmission of the waveguide-transmission line transition 100. FIG. 11 demonstrates that the transition 100 has a low power-loss characteristic such that the reflection is −40 dB or less and the transmission loss is 0.3 dB or less as measured at a predetermined operation frequency $f_0$. It is to be noted that FIG. 11 shows characteristics measured under the following conditions: strip-line insertion length $\rho$=0.18 L; matching-element length L=0.5 $\lambda g$; distance d between the strip line 3 and the matching element 6=0.05 $\lambda g$; dielectric constants of the dielectric substrates, 4 and 7=2.2; and the distance between the short-circuiting plate 1 and the strip line 3=0.04 $\lambda g$.

In the present embodiment, as shown in FIGS. 1 and 2A–2D, the dielectric substrate 4 has a shape which is substantially congruent with the shape of the slit of the short-circuiting plate 1. However, the dielectric substrate 4 may be formed integrally with the dielectric substrate 7, a microwave or millimeter-wave circuit.

When the dielectric substrate 4 is formed integrally with the dielectric substrate 7 or a microwave or millimeter-wave circuit, the size and cost of the waveguide-transmission line transition 100 can be reduced, and mass production becomes possible, without causing deterioration of power-conversion efficiency.

Figure 3:
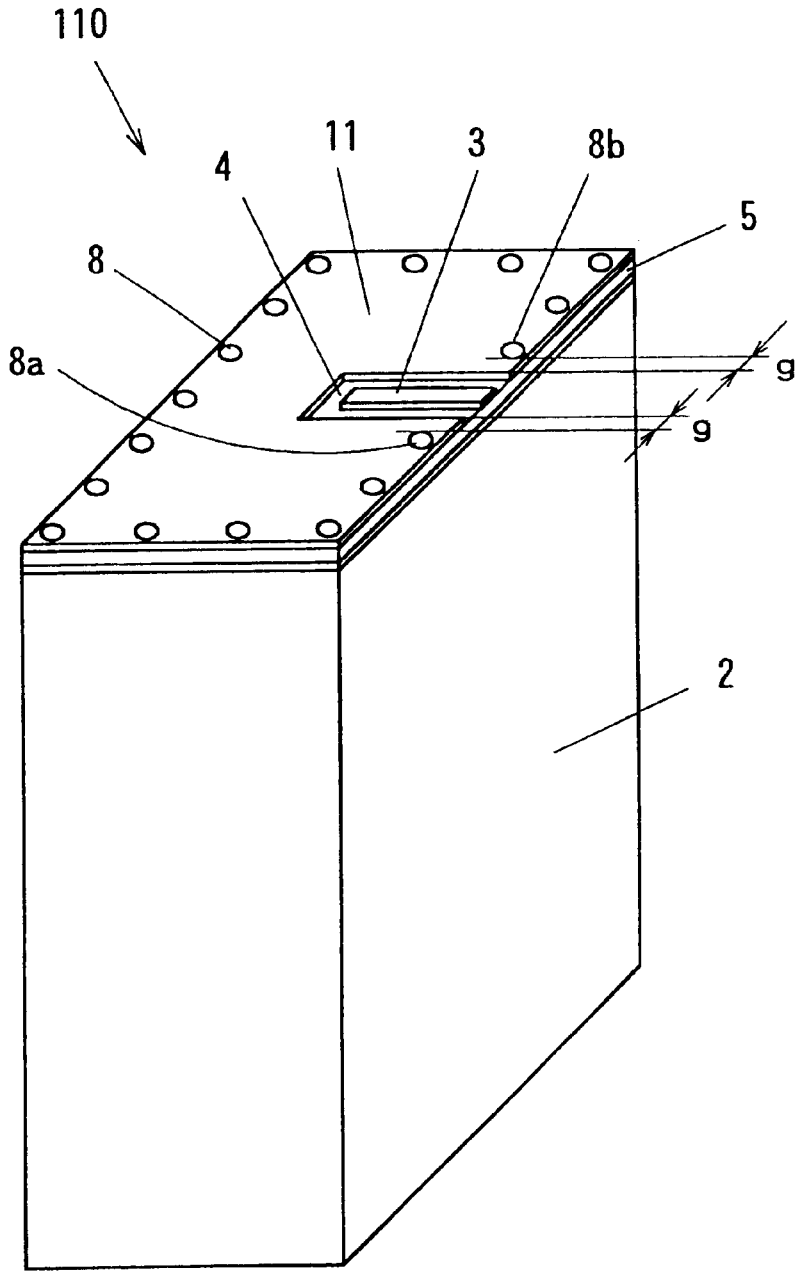
FIG. 3 is a perspective view of a waveguide-transmission line transition 110 of a second embodiment.
Figures 4A, 4B, 4C, 4D:
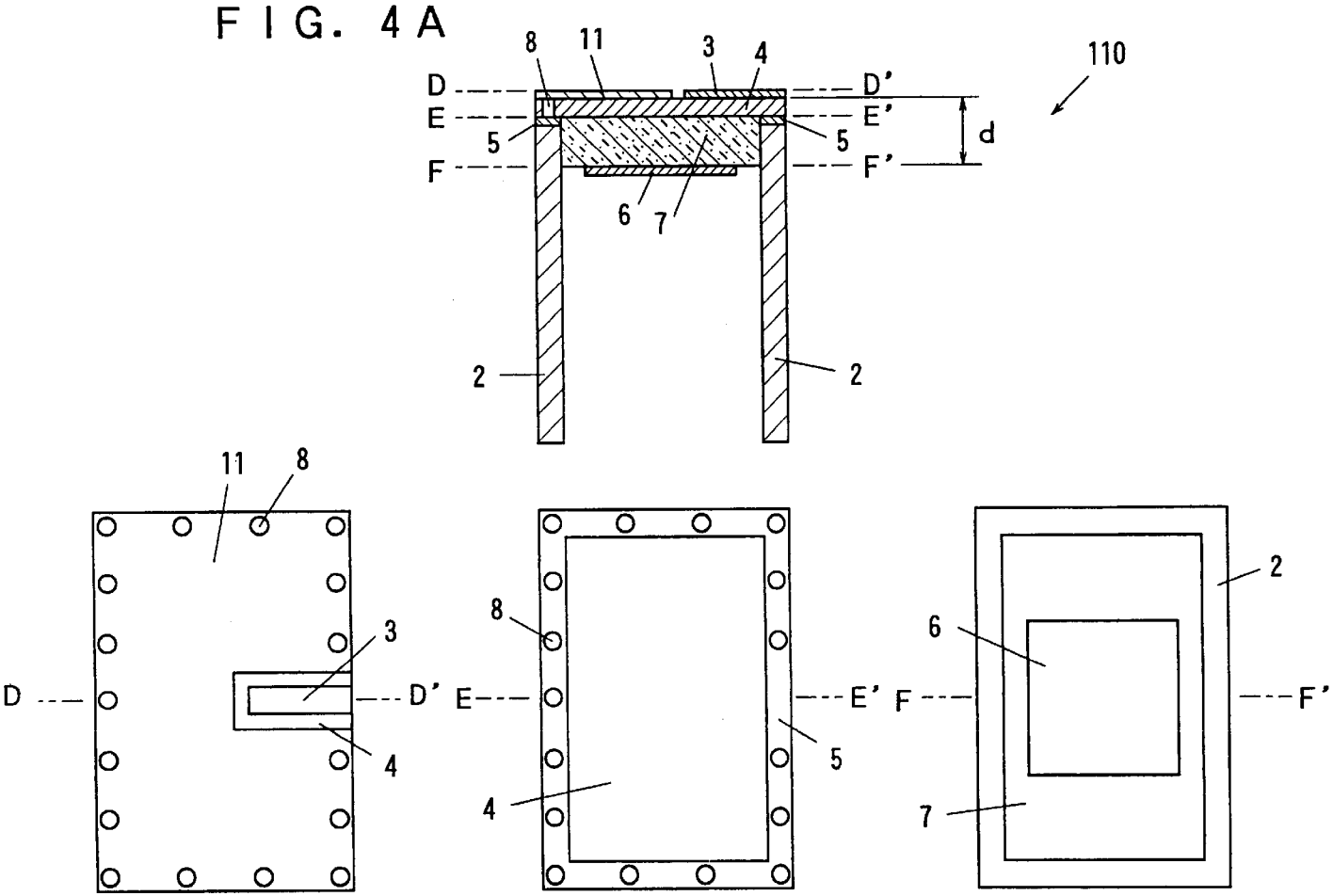
FIGS. 4A, 4C, and 4D are cross-sectional views of the transition 110 of the second embodiment.
FIG. 4B is a plan view of the transition 110 of the second embodiment.

Second Embodiment:

FIG. 3 is a perspective view of a waveguide-transmission line transition 110 of a second embodiment; FIGS. 4A, 4C, and 4D are cross-sectional views of the transition 110; and FIG. 4B is a plan view of the transition 110.

The positional relationships among the waveguide 2, the strip line 3, the matching element 6, and the dielectric substrate (second dielectric substrate) 7 of the waveguide-transmission line transition 110 are the same as those of the wavequide-transmission line transition 100 of the first, embodiment. Accordingly, the transition 110 of the present embodiment has the same conversion function as does the transition 100 of the first embodiment.

However, the transition 110 of the present embodiment greatly differs from the transition 100 of the first embodiment in that a waveguide short-circuiting surface—which in the transition 100 is formed by means of the short-circuiting plate 1—is formed by means of a short-circuiting metal layer 11 formed on the dielectric substrate.

Specifically, the short-circuiting metal layer 11 is formed on one surface of the dielectric substrate (first dielectric substrate) 4 of the transition 110 (FIGS. 3 and 4A–4D). The short-circuiting metal layer 11 has a slit, in which the strip line 3 is disposed, so that the short-circuiting metal layer 11 and the strip line 3 are disposed on the same plane with a predetermined gap formed therebetween.

The grounding metal layer 5 is formed on the other surface of the dielectric substrate 4 to have a shape which is substantially congruent with the cross-sectional shape of the opening surface of the waveguide 2. The short-circuiting metal layer 11, the grounding metal layer 5, and the waveguide 2 are maintained at the same potential via metal embedded in through-holes 8 provided along the circumferential, edge of the dielectric substrate 4.

As in the case of the transition 100, the matching element 6 is provided on one surface of the dielectric substrate 7, and the other surface of the dielectric substrate 7 is bonded to the dielectric substrate 4 (as best seen in FIG. 4A).

Figure 12:
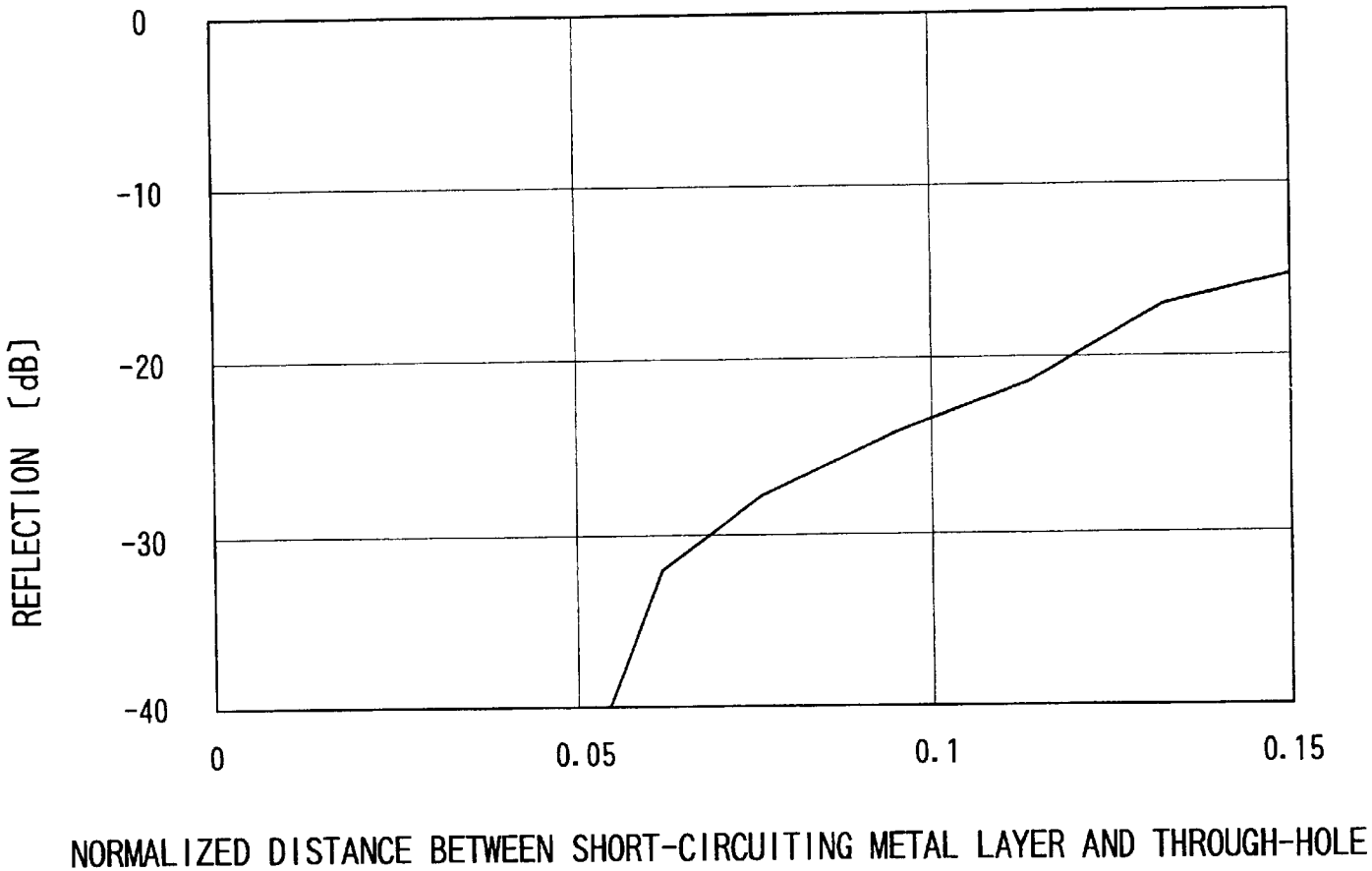
FIG. 12 is a characteristic chart obtained through determination of the relationship between the reflection and the normalized distance between the end of the short-circuiting metal layer and the end of the through-hole of the waveguide-transmission line transition 110 of the second embodiment.

As shown in FIG. 3, the positions of two through-holes 8*a* and 8*b* located on opposite sides of the strip line 3 affect impedance matching. FIG. 12 shows the relationship between the input-side reflection and the position g of the two through-holes 8*a* and 8*b* located on opposite sides of the strip line 3. As shown in FIG. 3, the position g is defined to be a gap g between an end of the short-circuiting metal layer 11 and the end of the corresponding through-hole 8*a* or 8*b* as measured along a direction parallel to a longer side of the waveguide 2.

When the gap g is set to fall within a range of 0.01 λg to 0.12 λg, the reflection can be decreased −20 dB or less.

Like the transition 100 of the first embodiment, the transition 110 of the present embodiment has characteristics as shown in FIGS. 9, 10, and 11. That is, as in the case of the transition 100 of the first embodiment, the input-side voltage standing wave ratio can be controlled through adjustment of the strip line length ρ. Therefore, impedance matching can be realized on the input and output sides of the transition.

In addition, the resonant frequency f can be controlled through adjustment of the matching-element length L. Further, a low power-loss characteristic can be realized when the distance d between the strip line 3 (see FIG. 4A) and the matching element 6 as measured along the axis of the waveguide 2 (the total thickness of the dielectric substrates 4 and 7 shown in FIG. 4A) is set to satisfy the relationship $0.01\ \lambda g \leqq d \leqq 0.20\ \lambda g$. Also, such a low power-loss characteristic can be realized when the dielectric constants of the dielectric substrates 4 and 7 are set to fall within a range of 1 to 10. Further, such a low power-loss characteristic can be realized when the distance between the short-circuiting plate 1 and the strip line 3 is set to fall within a range of 0.03 λg to 0.06 λg.

Since the dielectric substrate 4 can be extended toward the outside of the waveguide 2, a microwave or millimeter-wave circuit or a planar antenna can be formed on the extended portion. That is, when the structure of the waveguide-transmission line transition 110 is employed, a portion (the dielectric substrate 4, the strip line 3,the short-circuiting metal layer 11, grounding metal layer 5, etc.) of the transition 110 can be formed in the same photo etching step in which the microwave or millimeter-wave circuit or the planar antenna are formed. Therefore, when a circuit in which a microwave or millimeter-wave circuit or a planar antenna are combined with the waveguide-transmission line transition is to be formed, the production steps ,can be reduced in number and simplified in order to reduce production cost.

Figure 5:
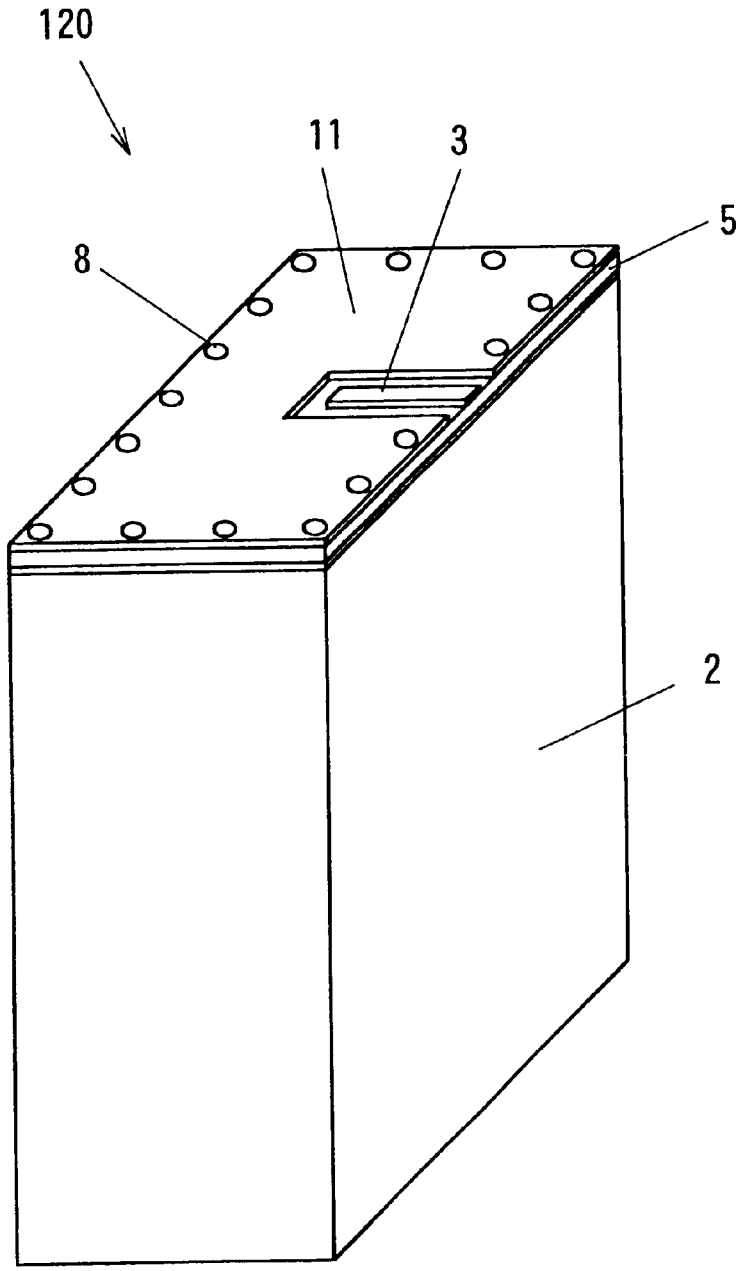
FIG. 5 is a perspective view of a waveguide-transmission line transition 120 of a third-embodiment.
Figure 6A:
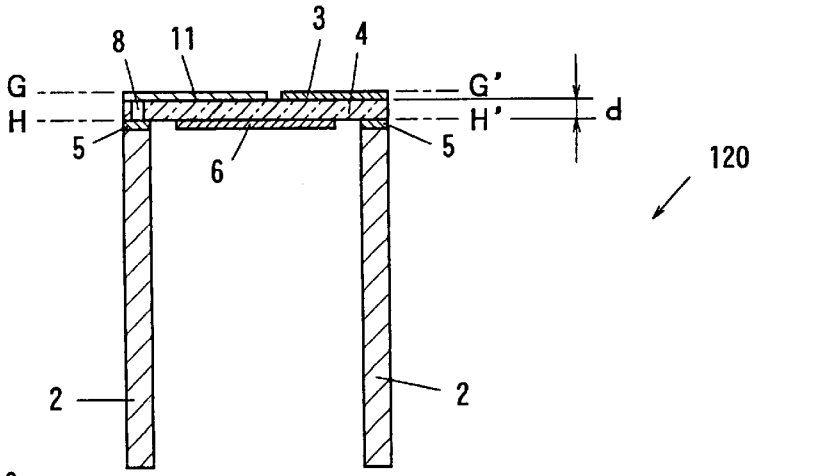
FIGS. 6A and 6C are cross-sectional views of the transition 120 of the third embodiment.
Figure 6B:
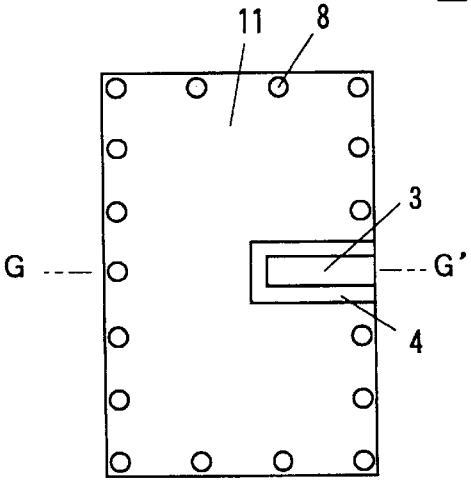
FIG. 6B is a plan view of the transition 120 of the third embodiment.
Figure 6C:
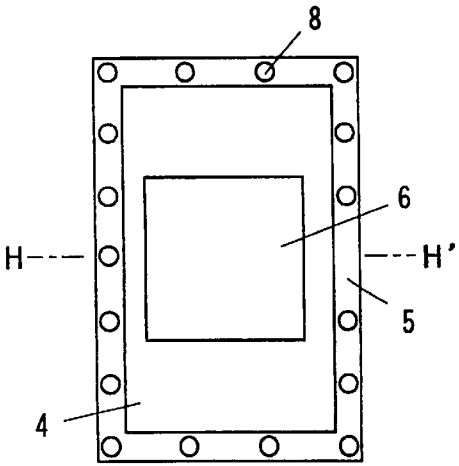

Third Embodiment:

FIG. 5 is a perspective view of a waveguide-transmission line transition 120 of a third embodiment; FIGS. 6A and 6C are cross-sectional views of the transition 120; and FIG. 6B is a plan view of the transition 120.

The transition 120 of the present embodiment is identical with the transition 110 of the second embodiment, except that the dielectric substrate 7 is removed and the matching element 6 is formed on the same surface of the dielectric substrate 4 on which the grounding metal layer 5 is formed (as best seen in FIG. 6A).

Specifically, the short-circuiting metal layer 11 is formed on one surface of the dielectric substrate 4 of the transition 120. The short-circuiting metal layer 11 has a slit, in which the strip line 3 is disposed, so that the short-circuiting metal layer 11 and the strip line 3 are disposed on the:same plane with a predetermined gap formed therebetween.

The grounding metal layer 5 is formed on the other surface of the dielectric substrate 4 to have a shape which is substantially congruent with the cross-sectional shape of the opening surface of the waveguide 2. The short-circuiting metal layer 11, the grounding metal layer 5, and the waveguide 2 are maintained at the same potential via metal embedded in through-holes 8 provided along the circumferential edge of the dielectric substrate 4.

Further, the matching element 6 is formed on the same surface of the dielectric substrate 4 on which the grounding metal layer 5 is formed.

In the waveguide-transmission line transition 120 having the above-described structure, substantially the entirety of the transition 120, except the waveguide 2, can be formed on the same substrate (dielectric substrate 4) on which a microwave or millimeter-wave circuit or a planar antenna are formed, and in the same photo etching step in which the microwave or millimeter-wave circuit-or the planar antenna are formed.

Further, when the structure of the transition 120 is employed, positional error which would be produced during formation of the matching element 6 does not have to be taken into consideration, so that mass production is greatly facilitated.

Therefore, when a circuit in which a microwave or millimeter-wave circuit or a planar antenna are combined with the waveguide-transmission line transition is to be formed, the production steps can be reduced in number and further simplified as compared to the waveguide-transmission line transition 110 of the second embodiment, so that production cost can be further reduced.

Like the transitions of the first and second embodiments, the transition 120 of the present embodiment has characteristics as shown in FIGS. 9, 10, and 11. That is, as in the case of the transitions of the first and second embodiments, the input-side voltage standing wave ratio can be controlled through adjustment of the strip line length ρ. Therefore, impedance matching can be realized on the input and output sides of the transition.

In addition, the resonant frequency f can be controlled through adjustment of the matching-element length L. Further, a low power-loss characteristic can be realized when the distance d between the strip line 3 and the matching element 6 as measured along the axis of the waveguide 2 (the thickness of the dielectric substrate 4 shown in FIG. 6A) is set to satisfy the relationship, 0.01

$\lambda g \leqq d \leqq 0.20\ \lambda g$. Also, such a low power-loss characteristic can be realized when the dielectric constant of the dielectric substrate 4 is set to fall within a range of 1 to 10. Further, such a low power-loss characteristic can be realized when the distance between the short-circuiting metal layer 11 and the strip line 3 is set to fall within a range of 0.03 $\lambda g$ to 0.06 $\lambda g$.

Further, like the transition of the second embodiment, the transition 120 of the present embodiment has characteristics as shown in FIG. 12. That is, when the gap g between an end of the short-circuiting metal layer 11 and the end of the corresponding through-hole 8*a* or 8*b* is set to fall within a range of 0.01 $\lambda g$ to 0.12 $\lambda g$, the reflection can be reduced to −20 dB or less.

Fourth Embodiment:

In each of the waveguide-transmission line transitions of the first through third embodiments, a single strip line 3 is provided. However, a plurality of strip lines 3 may be provided on the waveguide short-circuiting surface as in the case of a waveguide-transmission line transition 140 shown in FIG. 7.

Figure 7:
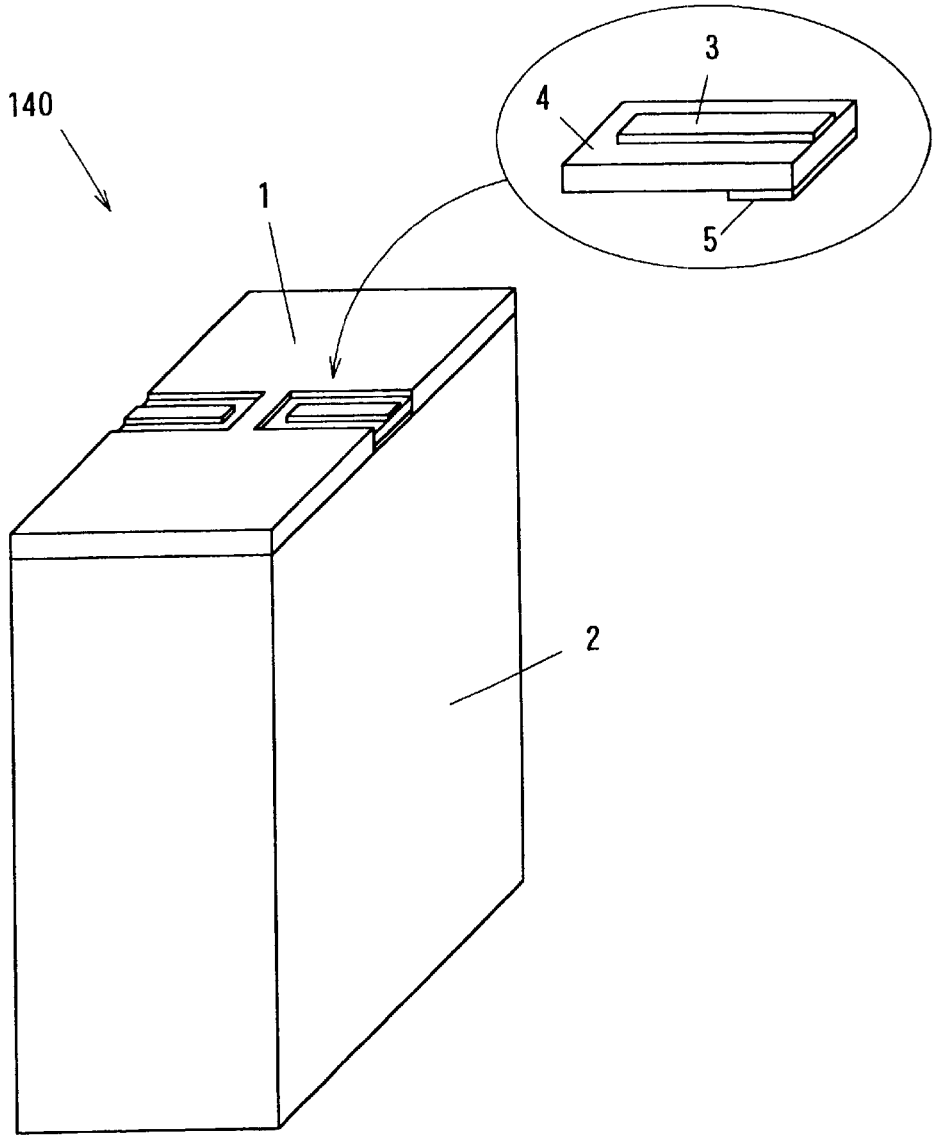
FIG. 7 is a perspective view of a waveguide-transmission line transition 140 of a fourth embodiment.

FIG. 7 is a perspective view of the waveguide-transmission line transition 140 in which a plurality of (two) strip lines 3 are provided on the waveguide short-circuiting surface. FIGS. 8A, 8C, and 8D are cross-sectional views of the transition 140; and FIG. 8B is a plan view of the transition 140.

It is obvious that the structure employing a plurality of strip lines 3 can applied to the waveguide-transmission line transitions according to the second and third embodiments.

Figures 8A, 8B, 8C, 8D:
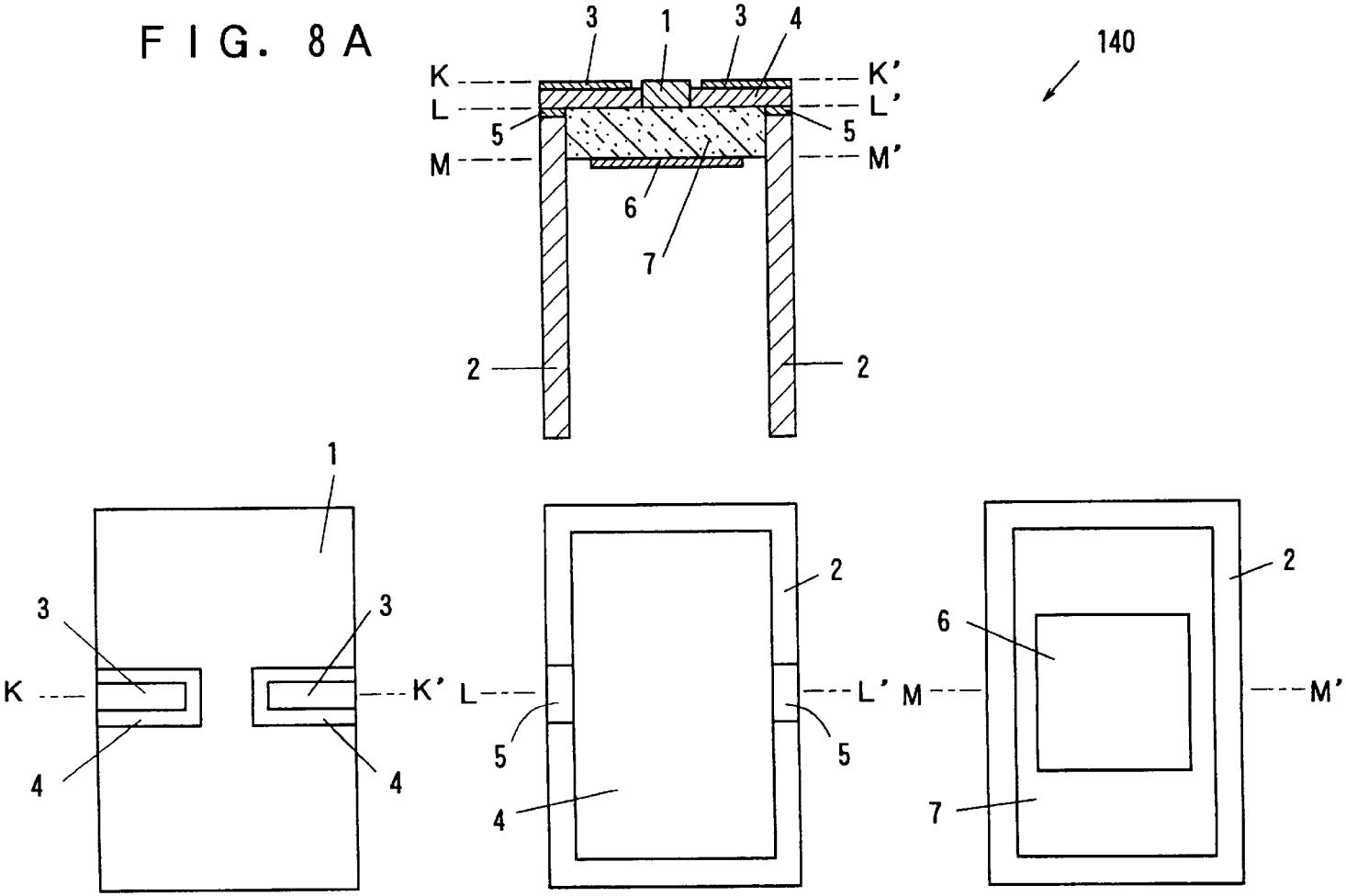
FIGS. 8A, 8C, and 8D are cross-sectional views of the transition 140 of the fourth embodiment.
FIG. 8B is a plan view of the transition 140 of the fourth embodiment.

The waveguide-transmission line transition 140 of the present embodiment is considered to have a structure which is modified from the waveguide-transmission line transition 100 of the first embodiment, such that two slits are formed in the short-circuiting plate 1 symmetrically in the left/right direction in FIG. 8B, and the strip line 3 is disposed in each of the slits. That is, the waveguide-transmission line transition 140 of the present embodiment has the same structure as that of the waveguide-transmission line transition 100 of the first embodiment, except with regard to the number of the slits formed in the short-circuiting plate 1 and the number of the strip lines 3.

The waveguide-transmission line transition having a plurality of strip lines 3 on the waveguide short-circuiting surface can be used as a microwave splitter for dividing and converting a power signal transmitted from a single waveguide 2 into a plurality of power signals to be transmitted through a plurality of strip lines 3, or as a microwave mixer for mixing and converting a plurality of power signals transmitted from a plurality of strip lines 3 into a power signal to be transmitted through a single waveguide 2.

In the waveguide-transmission line transition 140 of the present embodiments the number of the slits formed in the short-circuiting plate 1 and the number of the strip lines 3 are both two, and one-to-one correspondence is established between the slits and the strip lines. However, three or more slits maybe formed in the short circuiting plate 1 or the short-circuiting metal layer 11, and establishment of one-to-one correspondence between the slits and the strip lines 3 is not necessarily required In the second and third embodiments, the grounding metal layer 5 has a shape substantially congruent with the shape of the opening surface of the waveguide 2 (the cross-sectional shape of the waveguide 2). However, the grounding metal layer 5 may be formed to extend toward the inside of the waveguide 2.

For example, the grounding metal layer 5 of the waveguide-transmission line transition 120 of the third embodiment may have any shape, insofar as the distance between the grounding metal layer 5 and the matching element 6 is not less than a predetermined value and the grounding metal layer 5 contains a region corresponding to the cross section of the opening surface of the waveguide 2.

Figure 13:
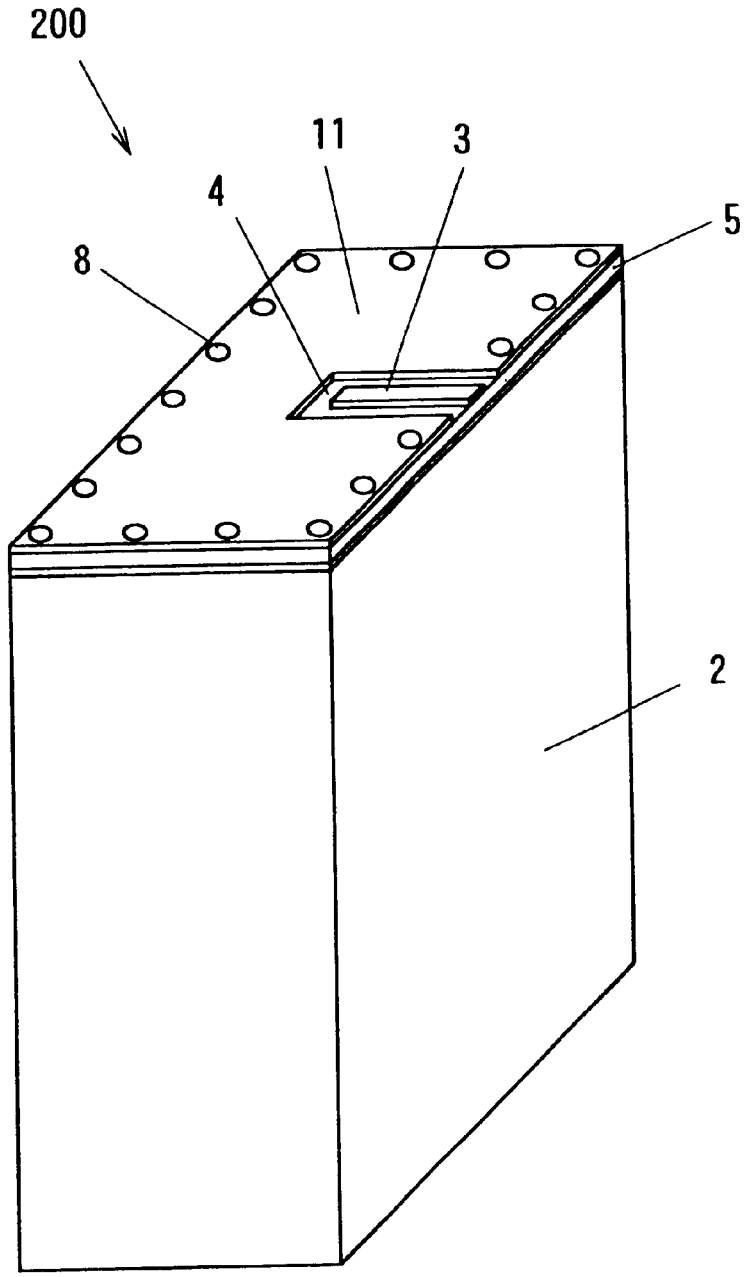
FIG. 13 is a perspective view of a waveguide-transmission line transition 200 of a fifth embodiment.
Figure 14A:
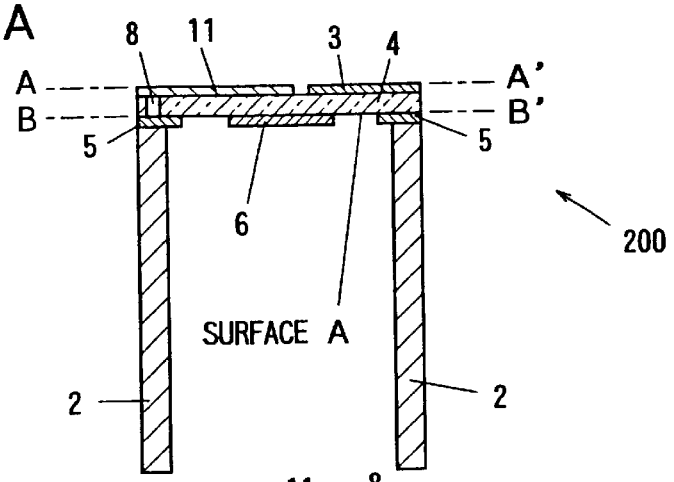
FIGS. 14A, and 14C are cross-sectional views of the transition 200 of the fifth embodiment.
Figure 14B:
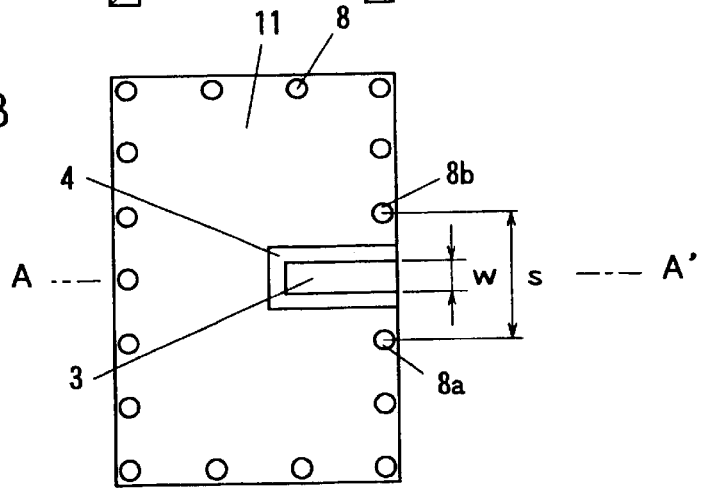
FIG. 14B is a plan view of the transition 200 of the fifth embodiment.
Figure 14C:
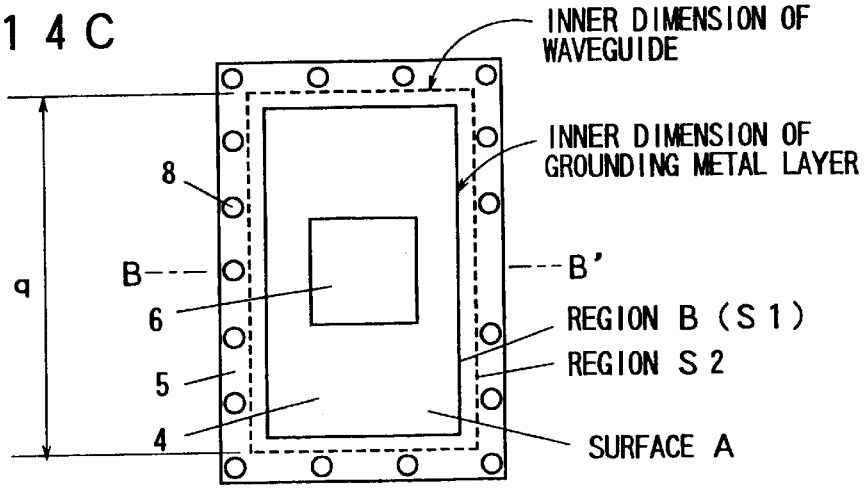

Fifth Embodiment:

FIG. 13 is a perspective view of a waveguide-transmission line transition 200 of a fifth embodiment; and FIGS. 14A and 14Care cross-sectional views, and FIG. 14B is a plan view of the transition 200.

A short-circuiting metal layer 11 having a slit is formed on one surface of a dielectric substrate 4, and a strip line 3 is disposed within the slit. A grounding metal layer 5 of a rectangular frame-like shape is formed on the other surface of the dielectric substrate 4. Since the width of each side of the grounding metal layer 5 is greater than the wall thickness of the waveguide 2, a portion of the grounding metal layer 5 projects toward the inside of the waveguide as best seen in FIG. 14A.

Radio waves input from a transmission line are electromagnetically transmitted from the strip line 3 to the matching element 6 disposed in the vicinity of the strip line 3 and are then transmitted to the waveguide 2. The matching element resonates at a certain frequency, at which conversion loss is minimized. The resonant frequency changes depending not only on the size of the matching element, but also on the distance between the matching element and the conductor (the grounding metal layer or the inner wall of the waveguide) located on the same plane.

Figure 15:
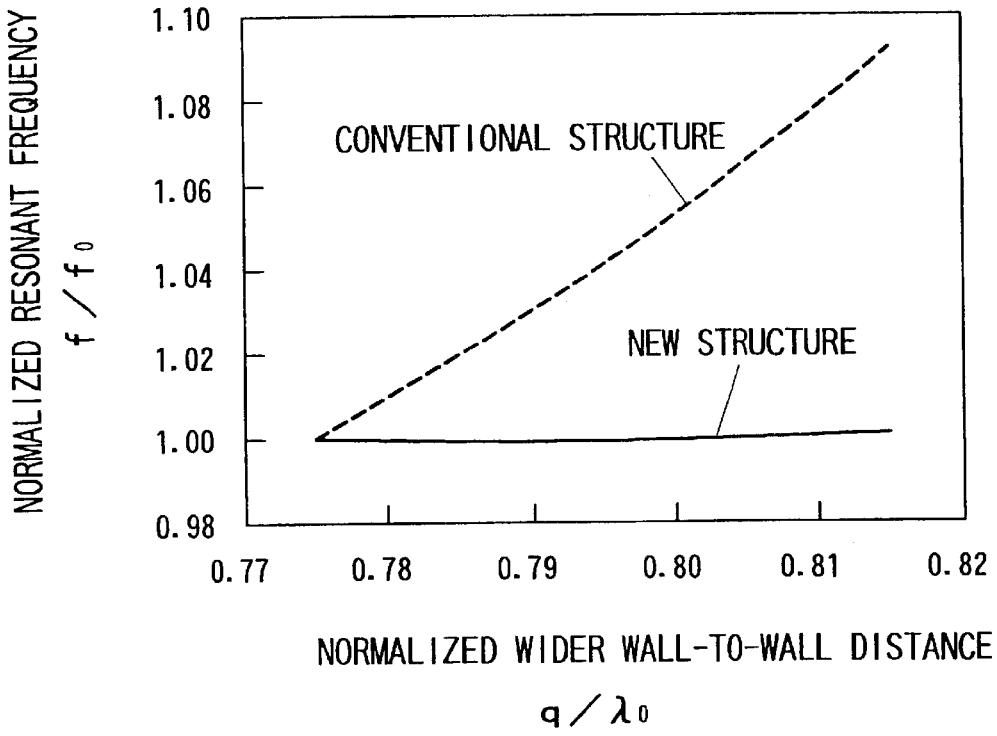
FIG. 15 is a characteristic chart obtained through determination of the relationship between waveguide width and resonant frequency of the transition 200 of the fifth embodiment.

FIG. 15 shows variation in the resonant frequency with the inner dimension (a wider wall-to-wall distance q) of the waveguide 2. When the inner dimension of the grounding metal layer 5 is rendered the same as the inner dimension of the waveguide 2, the resonant frequency changes greatly with the inner dimension of the waveguide 2. By contrast, in the structure of the fifth embodiment, since the inner dimension of the grounding metal layer 5 is rendered smaller than the inner dimension of the waveguide 2, the resonant frequency hardly changes with variation of the inner dimension of the waveguide 2.

Whereas the production accuracy of metal working is a few tens of microns to a few hundreds of microns, the production accuracy of photo etching is ten microns or less. In the above-described structure, since the resonant frequency is determined depending on only the matching element 6 and the grounding metal layer 5, which are formed by photo etching, deterioration in characteristics due to production errors can be reduced, as compared with the structure in which the resonant frequency changes depending on the wall-to-wall distance of the waveguide 2.

Figure 16:
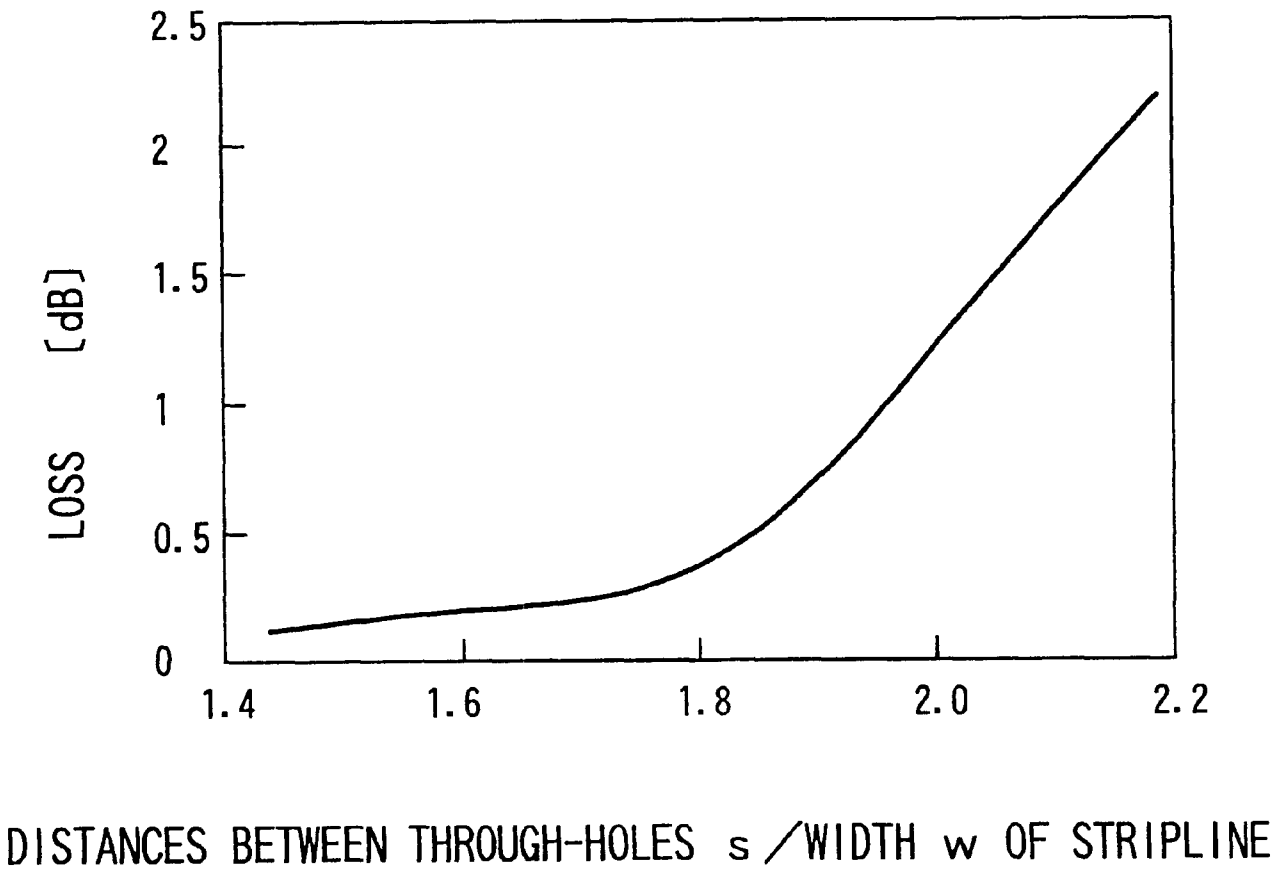
FIG. 16 is a characteristic chart obtained through determination of the relationship between power loss and distance between two through-holes sandwiching the strip line of the transition 200 of the fifth embodiment.

Further, power loss greatly depends on the distance between two through-holes 8*a* and 8*b* sandwiching the strip line 3. FIG. 16 shows the relationship between power loss and the distance between the two through-holes 8*a* and 8*b* as best seen in FIG. 14B. FIG. 16 demonstrates that the power loss can be reduced to 0.2 dB or less when the distance between the through-holes 8*a* and 8*b* is made 1.6 times or less the width of the strip line 3.

The power loss can be reduced further through provision of through-holes 17 along the circumferential edge of the short-circuiting metal layer.

Figure 17:
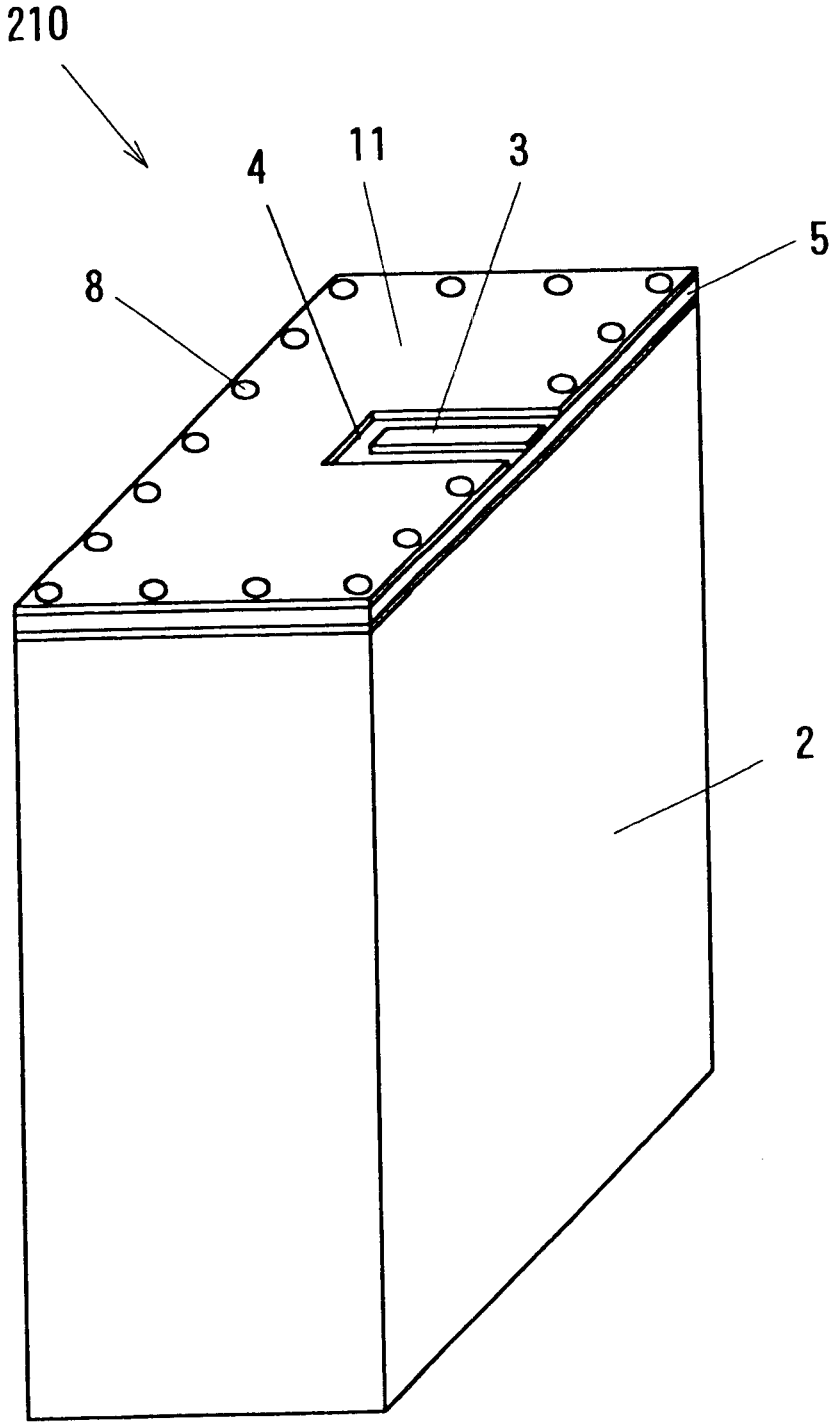
FIG. 17 is a perspective view of a waveguide-transmission line transition 210 of a sixth embodiment.
Figure 18C:
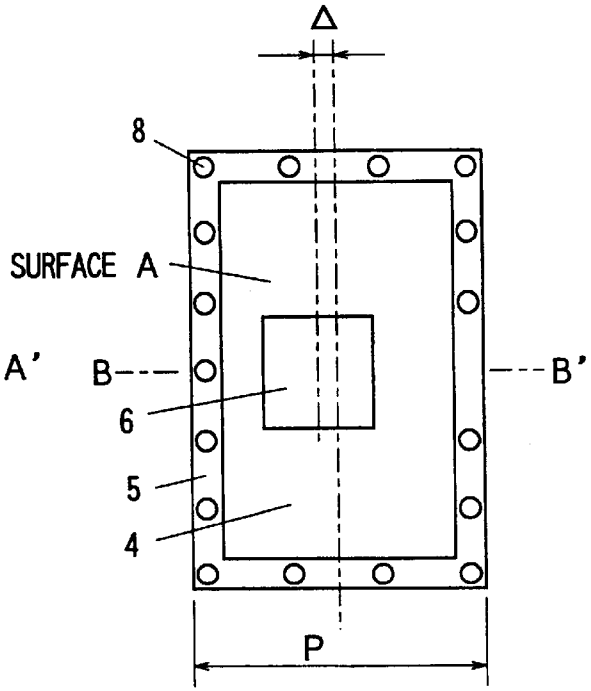
FIGS. 18A and 18C are cross-sectional views of the transition 210 of the sixth embodiment.
Figure 18B:
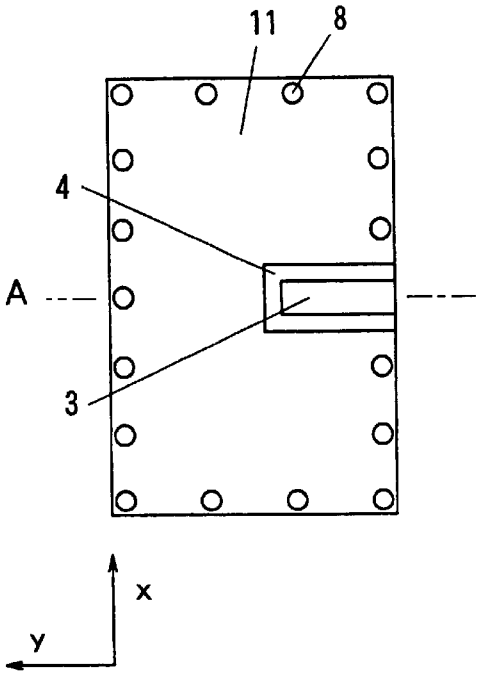
FIG. 18B is a plan view of the transition 210 of the sixth embodiment.
Figure 18A:
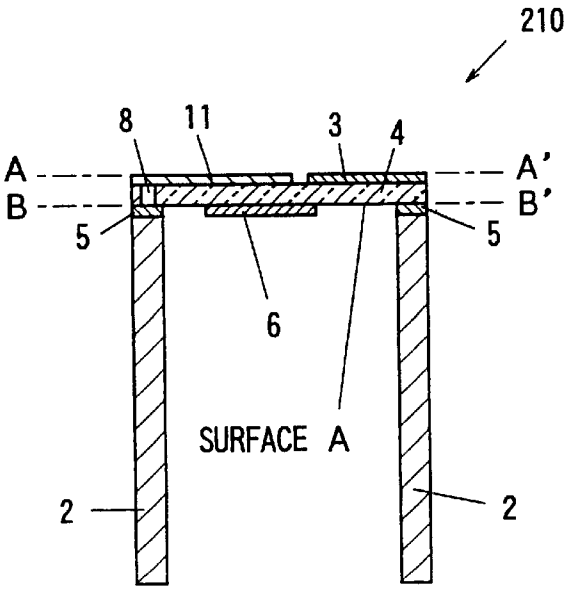

Sixth Embodiment:

FIG. 17 is a perspective view of a waveguide-transmission line transition 210 of a sixth embodiment; and FIGS. 18A and 18C are cross-sectional views and FIG. 18B is a plan view of the transition 210.

A short-circuiting metal layer 11 having a slit is formed on one surface of a dielectric substrate 4 of the transition, and a strip line 3 is disposed within the slit. A grounding metal layer 5 of a rectangular frame-like shape is formed on the other surface of the dielectric substrate 4. The width of each side of the grounding metal layer 5 is substantially equal to the wall thickness of the waveguide 2. A metal layer of a substantially square shape is formed at a position offset along the y-direction from the center of the rectangular frame formed by the grounding metal layer 5 by about +2% the narrower wall-to-wall distance of the waveguide.

Since the matching element 6 is disposed in proximity with the strip line 3, electromagnetic coupling is established between the matching element 6 and the strip line 3. The conductors (the short-circuiting metal layer 11, the strip line 3, the grounding metal layer 5, and the matching element 6) are formed by photoetching or any other suitable method.

Figure 19:
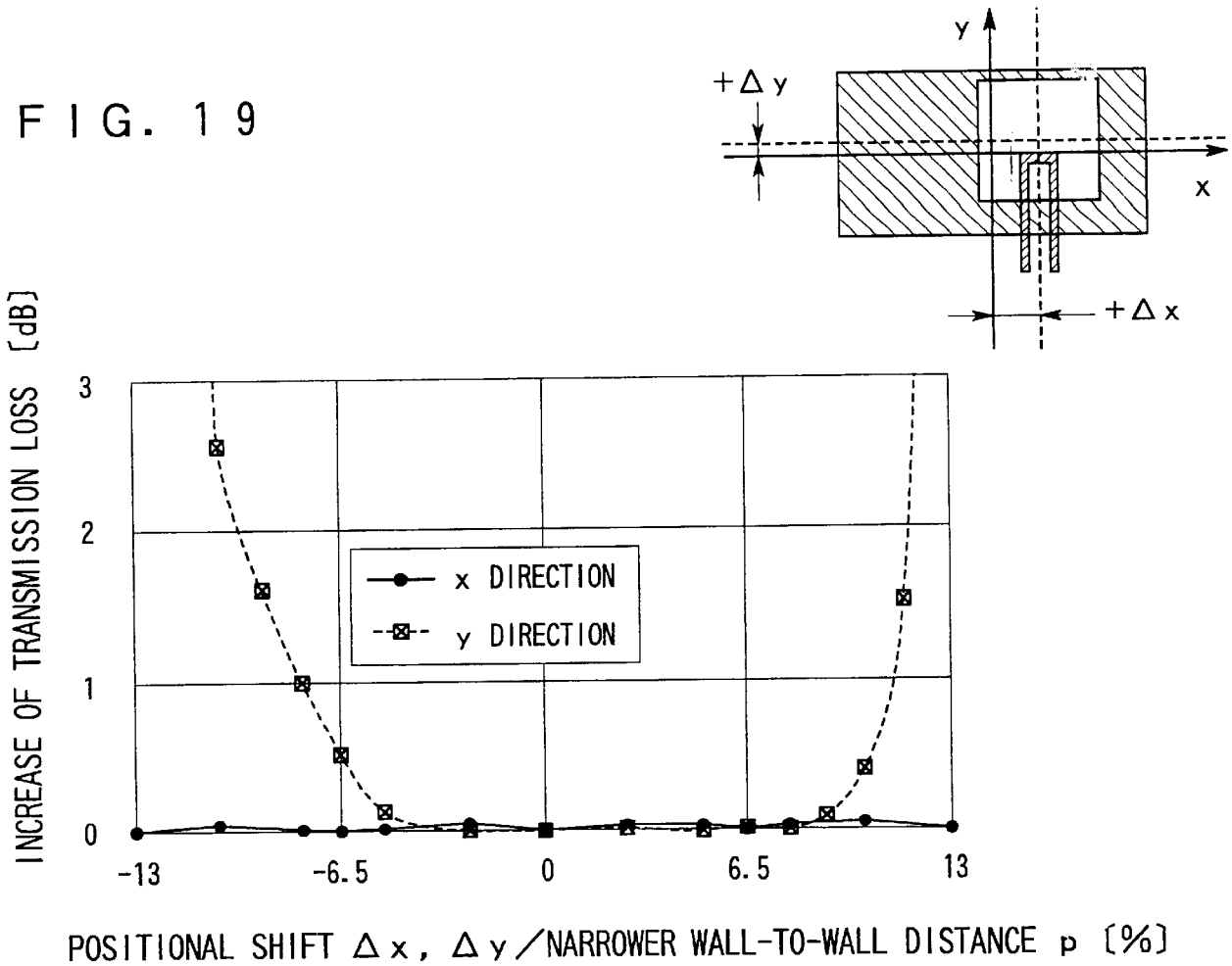
FIG. 19 is a characteristic chart obtained through determination of the relationship between shift amount of the waveguide and increase in transmission loss of the transition 210 of the sixth embodiment.

FIG. 19 shows the relationship between conversion loss and the amount of positional shift between the waveguide and the dielectric substrate subjected to photo etching. The amount of positional shift is a relative distance between the center of the waveguide and the center of the matching element. Although the loss does not increase with shift along the x-direction, the loss increases with shift along the y-direction. Specifically, the loss increases when the shift amount reaches +9% in the positive y-direction and also increases when the shift amount reaches −5% in the negative y-direction. That is, when the matching element 6 is designed to have a +2% positional offset along the y-direction, or to be located at the center of a range (−5% to +9%) in which variation in characteristics becomes small, transmission loss due to positional shift can be reduced to 0.1 dB or less if the transition is produced with a positional accuracy of the narrower wall-to-wall distance of the wave guide ±7%.

Figure 20:
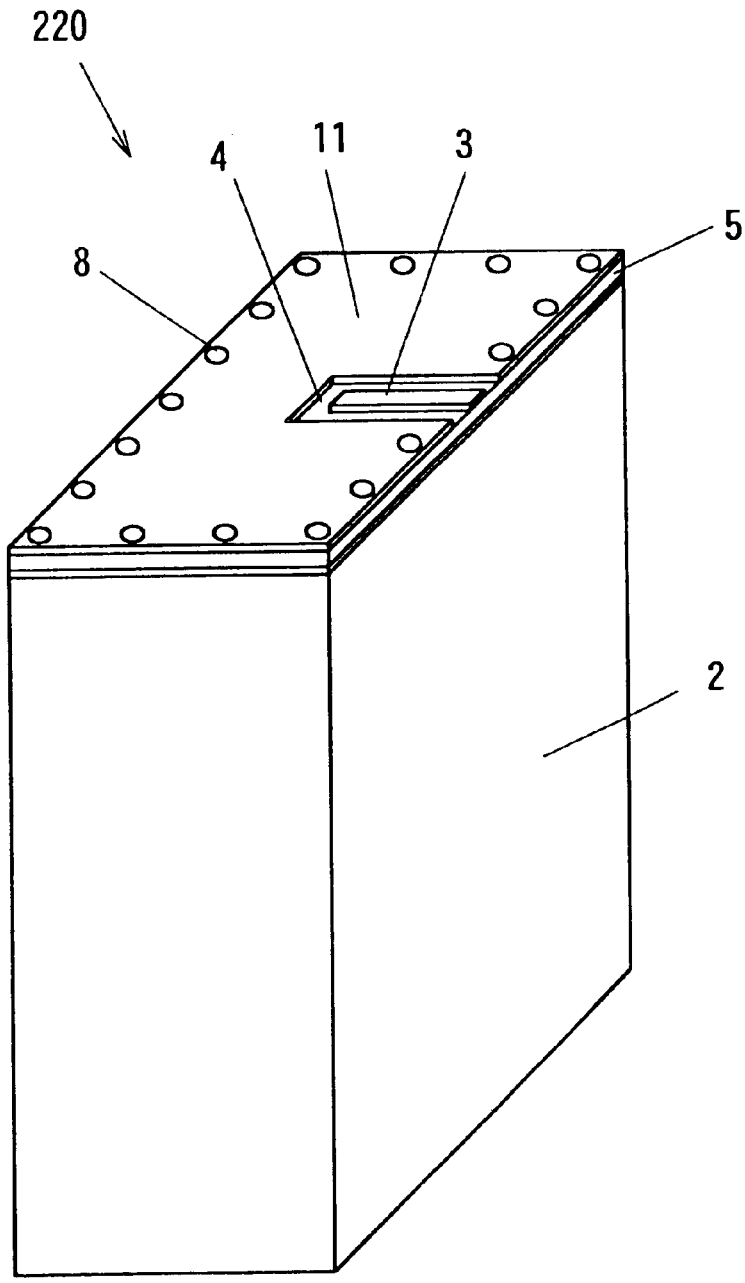
FIG. 20 is a perspective view of a waveguide-transmission line transition 220 of a seventh embodiment.

Seventh Embodiment:

FIG. 20 is.a perspective view of a waveguide-transmission line transition 220 of a seventh embodiment; FIGS. 21A, 21C, and 21D are cross-sectional views and FIG. 21B is a plan view of the transition 220.

Figures 21A, 21B, 21C, 21D:
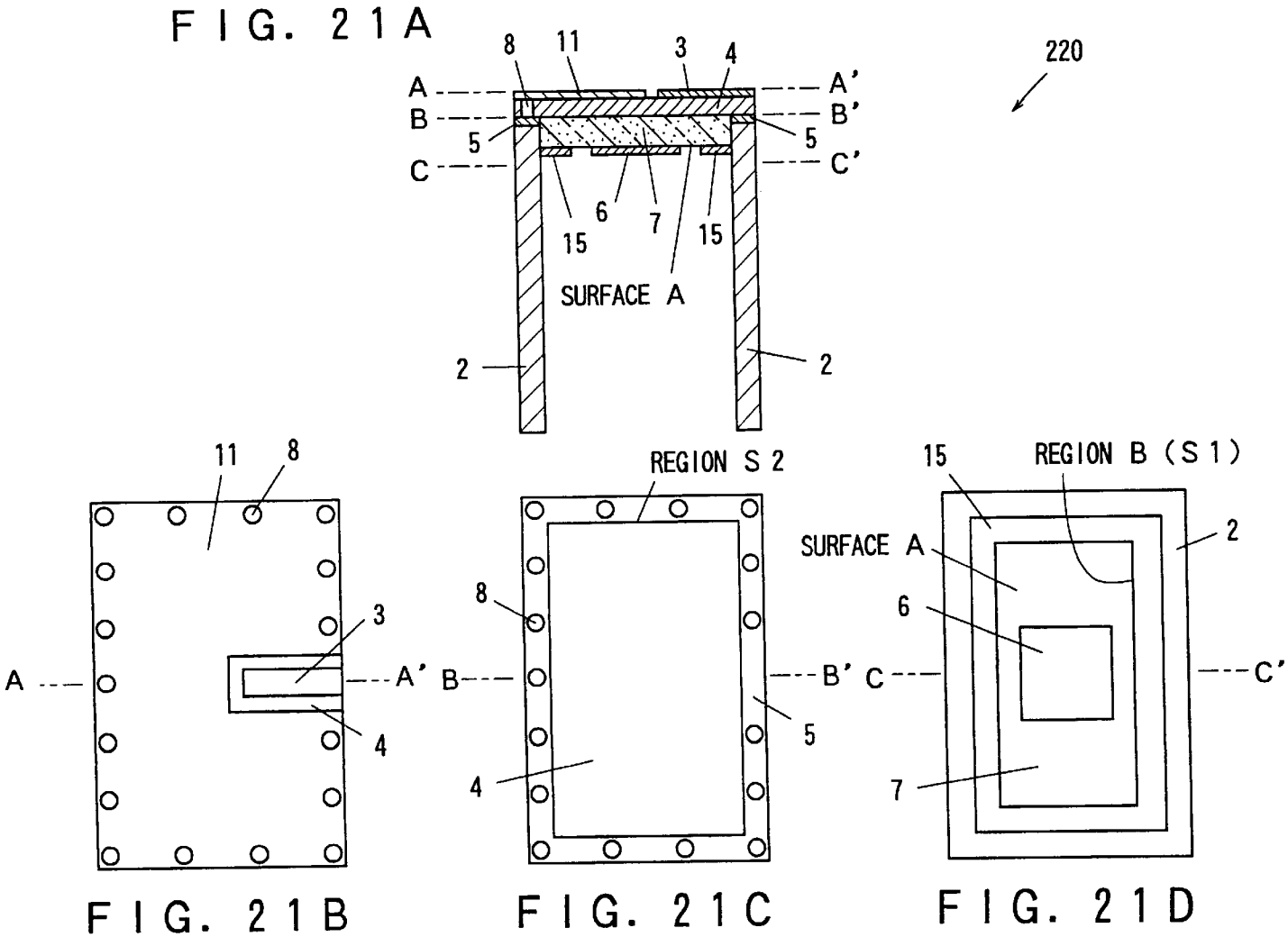
FIGS. 21A, 21C, and 21D are cross-sectional views of the transition 220 of the seventh embodiment.
FIG. 21B is a plan view of the transition 220 of the seventh embodiment.
Figure 22:
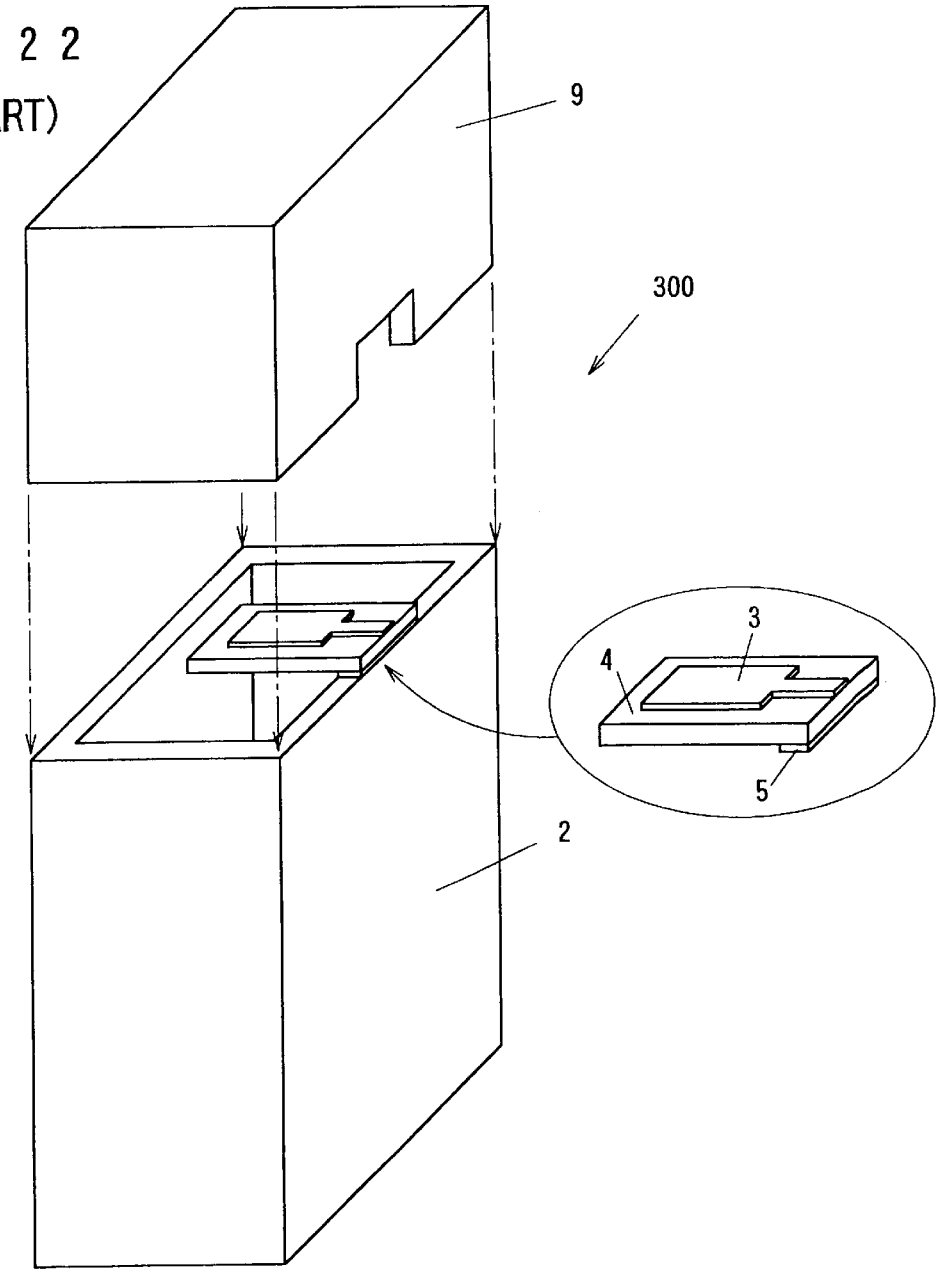
FIG. 22 (PRIOR ART)
FIG. 22 is a perspective view of a waveguide-transmission line transition 300 according to a prior art technique.
Figure 23A:
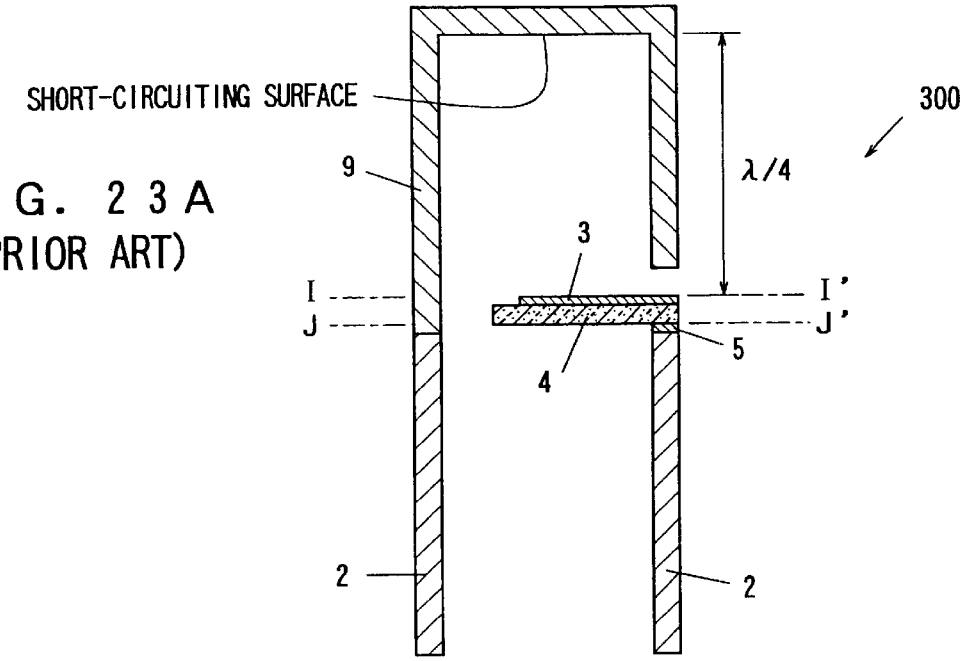
FIG. 23A (PRIOR ART)
FIG. 23A and 23C are cross-sectional views of the conventional transition 300.
Figure 23B:
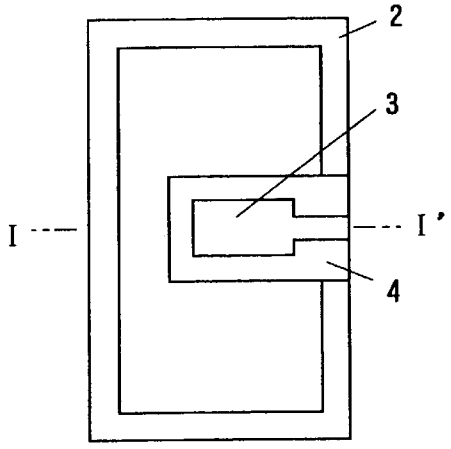
FIG. 23B (PRIOR ART)
FIG. 23B is a plan view of the conventional transition 300.
Figure 23C:
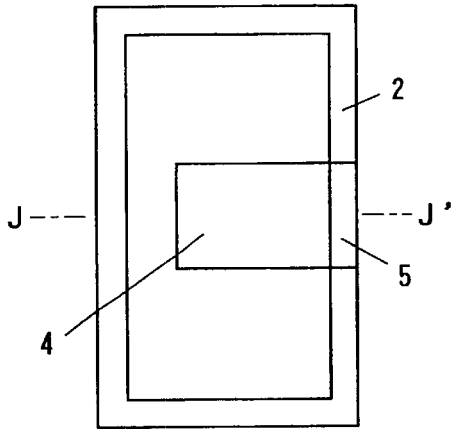
FIG. 23C (PRIOR ART)

The transition 220 of the present embodiment is identical with the transition 200 shown in FIGS. 13, 14A, 14B, and 14C, except that the dielectric substrate is formed of two elements, first and second dielectric substrates 4 and 7, and the grounding metal layer is formed of first and second grounding metal layers 5 and 15 as seen in FIG. 21A.

In the structure of the present embodiment, the distance between the short-circuiting metal layer 11 and the matching element 6 can be increased through provision of the of first and second dielectric substrates 4 and 7 therebetween. Thus, a frequency band in which power transmission and conversion are performed can be broadened. In addition, the distance between the second grounding metal layer 15 and the matching element 6 can be made constant regardless of the position of the second dielectric substrate 7 on the waveguide 2.

Although in the above-described embodiments the matching element 6 has a rectangular shape, no particular limitation is imposed on the shape of the matching element 6, and a circular shape, an annular shape, or any other suitable shape may be employed.

Although not specifically described in the above-described embodiments, a dielectric material or any other suitable material may be charged into the interior of the waveguide.

What is claimed is:

1. A waveguide-transmission line transition which includes a strip line projecting inward on an opening in a surface of a waveguide to be parallel to the opening and which effects mutual conversion between power transmitted through said waveguide and power transmitted through said strip line, comprising:

a plate-shaped short-circuiting member shielding the opening of said waveguide and having a slit in which said strip line is disposed;

a matching element disposed within said waveguide, said matching element being substantially parallel to and separated by a predetermined distance from said short-circuiting member; and a dielectric member disposed between said short-circuiting member and said matching element, wherein said strip line disposed in the slit and said matching element are disposed in proximity to each other to be capacitively coupled with each other.

2. A waveguide-transmission line transition according to claim 1, wherein said short-circuiting member is a short-circuiting plate having a slit in which said strip line is disposed; and said dielectric member comprises at least a first dielectric substrate which is inserted into the slit and which has said strip line on the outer surface-thereof.

3. A waveguide-transmission line transition according to claim 2, wherein said dielectric member further comprises a second dielectric substrate which is joined to reverse surfaces of said short-circuiting plate and said first dielectric substrate and on which said matching element is disposed.

4. A waveguide-transmission line transition according to claim 3, wherein said first dielectric substrate and said second dielectric substrate are integrated together.

5. A waveguide-transmission line transition according to claim 3, wherein said first dielectric substrate has on the reverse surface thereof, opposite the surface where said strip line is disposed, a grounding metal layer which comes into contact with an end face of a side wall at the opening of said waveguide.

6. A waveguide-transmission line transition according to claim 2, wherein said first dielectric substrate has on the reverse surface thereof, opposite the surface where said strip line is formed, a grounding metal layer which comes into contact with an end face of a side wall at the opening of said waveguide.

7. A waveguide-transmission line transition according to claim 1, wherein said dielectric member is formed of a first dielectric substrate shielding the opening of said waveguide and a second dielectric substrate which is joined to a reverse surface of said first dielectric substrate and on which said matching element is disposed; and said short-circuiting member is formed of a short-circuiting metal layer formed on an outer surface of the first dielectric substrate and having a slit, wherein said strip line is disposed in the slit of said short-circuiting metal layer.

8. A waveguide-transmission line transition according to claim 7, wherein said first dielectric substrate has on the reverse surface thereof, opposite the surface on which said strip line is disposed, a grounding metal layer which comes into contact with an end face of a side wall at the opening of said waveguide.

9. A waveguide-transmission line transition according to claim 8, wherein said grounding metal layer is disposed such that a region surrounded by an inner circumference of said grounding metal layer on the reverse surface of said first dielectric substrate is completely included in a region surrounded by an inner wall of said waveguide.

10. A waveguide-transmission line transition according to claim 8, wherein said short-circuiting metal layer and said grounding metal layer are electrically connected with each other by means of through-holes.

11. A waveguide-transmission line transition according to claim 9, wherein said short-circuiting metal layer and said grounding metal layer are electrically connected with each other by means of through-holes.

12. A waveguide-transmission line transition according to claim 8, wherein the center of said matching element is offset from the center of said waveguide by a predetermined distance along the longitudinal direction of said strip line toward a direction of projection of said strip line.

13. A waveguide-transmission line transition according to claim 12, wherein the predetermined distance falls within a range of about 1 to 4% of the narrower wall-to-wall distance of said waveguide.

14. A waveguide-transmission line transition according to claim 8, wherein a second grounding metal layer is disposed at a peripheral portion of said second dielectric substrate such that said second grounding metal layer is in contact with the side wall of said waveguide.

15. A waveguide-transmission line transition according to claim 7, wherein said first dielectric substrate and said second dielectric substrate are integrated together.

16. A waveguide-transmission line transition according to claim 1, wherein said strip line is disposed in each of a plurality of slits disposed in said short-circuiting member.

17. A waveguide-transmission line transition according to claim 1, wherein the center of said matching element is offset from the center of said waveguide by a predetermined distance along the longitudinal direction of said strip line toward a direction of projection of said strip line.

18. A waveguide-transmission line transition according to claim 7, wherein the predetermined distance falls within a range of about 1 to 4% of the narrower wall-to-wall distance of said waveguide.

19. A waveguide-transmission line transition according to claim 1, wherein said dielectric member is comprised of a dielectric substrate having a surface which shields the opening of said waveguide and which has said matching element on the reverse surface thereof; and said short-circuiting member is comprised of a short-circuiting metal layer disposed on the shielding surface of said dielectric substrate and having said slit therein, wherein said strip line is disposed in the slit of said short-circuiting metal layer.

20. A waveguide-transmission line transition according to claim 19, wherein said dielectric substrate has on the reverse surface thereof, opposite the shielding surface on which said strip line is provided, a grounding metal layer which comes into contact with an end face of a side wall at the opening of said waveguide.

21. A waveguide-transmission line transition according to claim 10, wherein at least two through-holes are disposed on opposite sides of an entrance of the slit; and the distance between the at least one through-holes is less than twice the width of said strip line.

22. A waveguide-transmission line transition according to claim 11, wherein at least two of said through-holes are disposed on opposite sides of an entrance of the slit, respectively; and the distance between the at least two of said through-holes is less than twice the width of said strip line.

23. A waveguide-transmission line transition according to claim 20, wherein said grounding metal layers is disposed such that a region surrounded by an inner circumference of said grounding metal layer on the reverse surface of said dielectric substrate is completely included in a region surrounded by an inner wall of said waveguide.

24. A waveguide-transmission line transition according to claim 20, wherein the center of said matching element is offset from the center of said waveguide by a predetermined distance along the longitudinal direction of said strip line toward a direction of projection of said strip line.

25. A waveguide-transmission line transition according to claim 24, wherein the predetermined distance falls within a range of about 1 to 4% of the narrower wall-to-wall distance of said waveguide.

26. A waveguide-transmission line transition according to claim 1, wherein the distance between said strip line and said short-circuiting member, as measured along the axis of the waveguide, falls within a range of 0.03 to 0.06 $\lambda g$, where $\lambda g$ is a transmission wavelength of a signal propagating within a medium existing between said strip line and said short-circuiting member.

27. A waveguide-transmission line transition according to claim 1, wherein said dielectric member is integral with a circuit substrate on which a microwave or millimeter-wave circuit is disposed.

28. A waveguide-transmission line transition according to claim 1, wherein impedance adjustment is performed through adjustment of a length over which said strip line overlaps with said matching element.

29. A waveguide-transmission line transition according to claim 1, wherein resonant frequency adjustment is performed through adjustment of the length of said matching element along a direction parallel to said strip line.

30. A waveguide-transmission line transition according to claim 1, wherein the distance between said strip line and said matching element, as measured along the axis of this waveguide, falls within a range of 0.01 to 0.20 $\lambda g$, where $\lambda g$ is a transmission wavelength of a signal propagating within the dielectric member existing between said strip line and said matching element.

* * * * *

UNITED STATES PATENT AND TRADEMARK OFFICE

CERTIFICATE OF CORRECTION

PATENT NO. : 6,580,335 B1
DATED : June 17, 2003
INVENTOR(S) : Hideo Iizuka et al.

It is certified that error appears in the above-identified patent and that said Letters Patent is hereby corrected as shown below:

Column 15,
Line 48, change “claim 7, wherein” to -- claim 17, wherein --.

Signed and Sealed this

Fourth Day of November, 2003

JAMES E. ROGAN
*Director of the United States Patent and Trademark Office*